US007710369B2

(12) United States Patent
Dowling

(10) Patent No.: US 7,710,369 B2
(45) Date of Patent: May 4, 2010

(54) COLOR MANAGEMENT METHODS AND APPARATUS FOR LIGHTING DEVICES

(75) Inventor: Kevin J. Dowling, Westford, MA (US)

(73) Assignee: Philips Solid-State Lighting Solutions, Inc., Burlington, MA (US)

( * ) Notice: Subject to any disclaimer, the term of this patent is extended or adjusted under 35 U.S.C. 154(b) by 1169 days.

(21) Appl. No.: 11/313,427

(22) Filed: Dec. 20, 2005

(65) Prior Publication Data

US 2006/0158881 A1 Jul. 20, 2006

Related U.S. Application Data

(60) Provisional application No. 60/637,554, filed on Dec. 20, 2004, provisional application No. 60/716,111, filed on Sep. 12, 2005.

(51) Int. Cl.
*G09G 3/32* (2006.01)

(52) U.S. Cl. ..... 345/83; 362/231

(58) Field of Classification Search ..... 345/82, 345/83, 690, 589–591; 362/230, 231; 313/112, 313/113; 358/475, 518, 520; 382/162, 167; 315/291, 316

See application file for complete search history.

(56) References Cited

U.S. PATENT DOCUMENTS 5,809,213 A 9/1998 Bhattacharjya
6,016,038 A 1/2000 Mueller et al.
6,150,774 A 11/2000 Mueller et al.
6,166,496 A 12/2000 Lys et al.
6,211,626 B1 4/2001 Lys et al.
6,292,901 B1 9/2001 Lys et al.
6,329,764 B1 * 12/2001 van de Ven ..... 315/291
6,340,868 B1 1/2002 Lys et al.
6,414,756 B1 7/2002 Tsukada
6,459,919 B1 10/2002 Lys et al.
6,495,964 B1 * 12/2002 Muthu et al. ..... 315/149
6,498,440 B2 * 12/2002 Stam et al. ..... 315/291
6,528,954 B1 3/2003 Lys et al.
6,548,967 B1 4/2003 Dowling et al.
6,552,829 B1 * 4/2003 Maciey et al. ..... 358/509
6,577,080 B2 6/2003 Lys et al.
6,608,453 B2 8/2003 Morgan et al.

(Continued)

OTHER PUBLICATIONS www.poynton.com/PDFs/coloureq.pdf, Ford et al., *Colour Space Conversions*, Aug. 11, 1998(b), pp. 1-31.

*Primary Examiner*—Richard Hjerpe
*Assistant Examiner*—Tom V Sheng
(74) *Attorney, Agent, or Firm*—Mark L. Beloborodov

(57) ABSTRACT

Color management and color-managed workflow concepts are applied to lighting apparatus configured to generate multi-colored light, including lighting apparatus based on LED sources. In particular, color management principles are employed to facilitate the generation of variable color light from a given lighting apparatus based on any of a number of possible input specifications for a desired color. In one example, a transformation between an arbitrary input specification for a desired color and a lighting command processed by the lighting apparatus is accomplished via the use of a source color management profile for the input specification of the desired color, a target color management profile for the lighting apparatus, and a common working color space. Colors defined in the common working color space may be reproduced or approximated (e.g., according to one or more rendering intents) by one or more lighting apparatus.

16 Claims, 12 Drawing Sheets

U.S. PATENT DOCUMENTS 6,624,597 B2 9/2003 Dowling et al.
6,717,376 B2 4/2004 Lys et al.
6,720,745 B2 4/2004 Lys et al.
6,765,585 B2 * 7/2004 Wada ..... 345/589
6,774,584 B2 8/2004 Lys et al.
6,777,891 B2 8/2004 Lys et al.
6,781,329 B2 8/2004 Morgan et al.
6,788,011 B2 9/2004 Mueller et al.
6,801,003 B2 10/2004 Schanberger et al.
6,806,659 B1 10/2004 Mueller et al.
6,869,204 B2 3/2005 Morgan et al.
6,883,929 B2 4/2005 Dowling
6,888,322 B2 5/2005 Dowling et al.
6,897,624 B2 * 5/2005 Lys et al. ..... 315/297
6,936,978 B2 8/2005 Morgan et al.
6,965,205 B2 11/2005 Piepgras et al.
6,967,448 B2 11/2005 Morgan et al.
6,969,954 B2 11/2005 Lys
6,975,079 B2 12/2005 Lys et al.
6,992,803 B2 * 1/2006 Chang ..... 358/509
7,027,015 B2 * 4/2006 Booth et al. ..... 345/83
7,067,985 B2 * 6/2006 Adachi ..... 315/169.3
7,164,428 B2 * 1/2007 Wada et al. ..... 345/590
7,173,384 B2 2/2007 Plötz et al.
7,324,240 B2 * 1/2008 Ng ..... 358/1.9
7,354,172 B2 * 4/2008 Chemel et al. ..... 362/231
7,414,755 B2 * 8/2008 Ott-Heizmann et al. ..... 358/1.9
2002/0038157 A1 3/2002 Dowling et al.
2002/0044066 A1 4/2002 Dowling et al.
2002/0048169 A1 4/2002 Dowling et al.
2002/0070688 A1 6/2002 Dowling et al.
2002/0074559 A1 6/2002 Dowling et al.
2002/0078221 A1 6/2002 Blackwell et al.
2002/0130627 A1 9/2002 Dowling et al.
2002/0145394 A1 10/2002 Morgan et al.
2002/0145869 A1 10/2002 Dowling
2002/0152045 A1 10/2002 Dowling et al.
2002/0158583 A1 10/2002 Lys et al.
2002/0176259 A1 11/2002 Ducharme
2003/0011538 A1 1/2003 Lys et al.
2003/0028260 A1 2/2003 Blackwell
2003/0057884 A1 3/2003 Dowling et al.
2003/0057887 A1 3/2003 Dowling et al.
2003/0076281 A1 4/2003 Morgan et al.
2003/0100837 A1 5/2003 Lys et al.
2003/0133292 A1 7/2003 Mueller et al.
2003/0222587 A1 12/2003 Dowling et al.
2004/0036006 A1 2/2004 Dowling
2004/0052076 A1 3/2004 Mueller et al.
2004/0090191 A1 5/2004 Mueller et al.
2004/0090787 A1 5/2004 Dowling et al.
2004/0105261 A1 6/2004 Ducharme et al.
2004/0113568 A1 6/2004 Dowling et al.
2004/0116039 A1 6/2004 Mueller et al.
2004/0130909 A1 7/2004 Mueller et al.
2004/0178751 A1 9/2004 Mueller et al.
2004/0212320 A1 10/2004 Dowling et al.
2004/0212321 A1 10/2004 Lys et al.
2004/0212993 A1 10/2004 Morgan et al.
2005/0099824 A1 5/2005 Dowling et al.
2005/0116667 A1 6/2005 Mueller et al.
2005/0151489 A1 7/2005 Lys et al.
2005/0174309 A1 8/2005 Bouwens et al.
2005/0213352 A1 9/2005 Lys et al.
2005/0213353 A1 9/2005 Lys
2005/0218838 A1 10/2005 Lys
2005/0218870 A1 10/2005 Lys
2005/0219872 A1 10/2005 Lys
2005/0231133 A1 10/2005 Lys
2005/0236029 A1 10/2005 Dowling
2005/0236998 A1 10/2005 Mueller
2005/0253533 A1 11/2005 Lys et al.
2005/0275626 A1 12/2005 Mueller
2005/0276053 A1 12/2005 Nortrup
2006/0002110 A1 1/2006 Dowling
2006/0012987 A9 1/2006 Ducharme
2006/0290624 A1 12/2006 Ashdown

* cited by examiner

PRIOR ART

PRIOR ART

PRIOR ART

COLOR MANAGEMENT METHODS AND APPARATUS FOR LIGHTING DEVICES

CROSS-REFERENCES TO RELATED APPLICATIONS

The present application claims the benefit, under 35 U.S.C. §119 (e), of the following U.S. Provisional Applications:

Ser. No. 60/637,554 , filed Dec. 20, 2004 , entitled "Systems and Methods for Emulating Illuminated Surfaces;" and Ser. No. 60/716,111 , filed Sep. 12, 2005 , entitled "Systems and Methods for Matching Lighting Color and Output.

Each of the foregoing applications is hereby incorporated herein by reference.

FIELD OF THE DISCLOSURE

The present disclosure relates generally to lighting devices configured to generate variable color light (and variable color temperature white light) based on principles of color management and color-managed workflow.

BACKGROUND

"Color management" is a term commonly used in computer environments to describe a controlled conversion between the colors of various color-generating or color-rendering devices (e.g., scanners, digital cameras, monitors, TV screens, film printers, printers, offset presses). For purposes of the present disclosure, color-generating or color-rendering devices (i.e., devices that reproduce color) are referred to generally as "color devices." The primary goal of color management is to obtain a good match for a variety of colors across a number of different color devices, or between digital color images and color devices. For example, color management principles may be employed to help ensure that a video looks virtually the same on a computer LCD monitor and on a plasma TV screen, and that a screenshot from the video printed on paper looks, from a color-content standpoint, like a paused still-frame on the computer LCD monitor or the plasma TV. Color management tools help achieve the same appearance on all of these color devices, provided each device is capable of actually generating the required variety of colors.

To discuss some of the salient concepts underlying color management, some general understanding of human color perception, and some common terminology often used to describe color perception, is required. While a detailed exposition of color science would be overwhelming, a few important aspects are presented below to facilitate a discussion of color management principles in the context of the present disclosure.

A well-known phenomenon of human vision is that humans have different sensitivities to different colors. The sensors or receptors in the human eye are not equally sensitive to all wavelengths of light, and different receptors are more sensitive than others during periods of low light levels versus periods of relatively higher light levels. These receptor behaviors commonly are referred to as "scotopic" response (low light conditions), and "photopic" response (high light conditions). In the relevant literature, the scotopic response of human vision as a function of wavelength $\lambda$ often is denoted as $V'(\lambda)$ whereas the photopic response often is denoted as $V(\lambda)$; both of these functions represent a normalized response of human vision to different wavelengths $\lambda$ of light over the visible spectrum (i.e., wavelengths from approximately 400 nanometers to 700 nanometers). For purposes of the present disclosure, human vision is discussed primarily in terms of lighting conditions that give rise to the photopic response, which is maximum for light having a wavelength of approximately 555 nanometers.

A visual stimulus corresponding to a perceivable color can be described in terms of the energy emission of some source of light that gives rise to the visual stimulus. A "spectral power distribution" (SPD) of the energy emission from a light source often is expressed as a function of wavelength $\lambda$, and provides an indication of an amount of radiant power per small constant-width wavelength interval that is present in the energy emission throughout the visible spectrum. The SPD of energy emission from a light source may be measured via spectroradiometer, spectrophotometer or other suitable instrument. A given visual stimulus may be thought of generally in terms of its overall perceived strength and color, both of which relate to its SPD.

One measure of describing the perceived strength of a visual stimulus, based on the energy emitted from a light source that gives rise to the visual stimulus, is referred to as "luminous intensity," for which the unit of "candela" is defined. Specifically, the unit of candela is defined such that a monochromatic light source having a wavelength of 555 nanometers (to which the human eye is most sensitive) radiating 1/683 Watts of power in one steradian has a luminous intensity of 1 candela (a steradian is the cone of light spreading out from the source that would illuminate one square meter of the inner surface of a sphere of 1 meter radius around the source). The luminous intensity of a light source in candelas therefore represents a particular direction of light emission (i.e., a light source can be emitting with a luminous intensity of one candela in each of multiple directions, or one candela in merely one relatively narrow beam in a given direction).

From the definition above, it may be appreciated that the luminous intensity of a light source is independent of the distance at which the light emission ultimately is observed and, hence, the apparent size of the source to an observer. Accordingly, luminous intensity in candelas itself is not necessarily representative of the perceived strength of the visual stimulus. For example, if a source appears very small at a given distance (e.g., a tiny quartz halogen bulb), the perceived strength of energy emission from the source is relatively more intense as compared to a source that appears somewhat larger at the same distance (e.g., a candle), even if both sources have a luminous intensity of 1 candela in the direction of observation. In view of the foregoing, a measure of the perceived strength of a visual stimulus, that takes into consideration the apparent area of a source from which light is emitted in a given direction, is referred to as "luminance," having units of candelas per square meter ($cd/m^2$). The human eye can detect luminances from as little as one millionth of a $cd/m^2$up to approximately one million $cd/m^2$ before damage to the eye may occur.

The luminance of a visual stimulus also takes into account the photopic (or scotopic) response of human vision. Recall from the definition of candela above that radiant power is given in terms of a reference wavelength of 555 nanometers. Accordingly, to account for the response of human vision to wavelengths other than 555 nanometers, the luminance of the stimulus (assuming photopic conditions) typically is determined by applying the photopic response $V(\lambda)$ to the spectral power distribution (SPD) of the light source giving rise to the stimulus. For example, the luminance L of a given visual stimulus under photopic conditions may be given by:

$$L=K(P_1V_1+P_2V_2+P_3V_3+\ldots) \quad (1)$$

where $P_1$, $P_2$, $P_3$, etc., are points on the SPD indicating the amount of power per small constant-width wavelength interval throughout the visible spectrum, $V_1$, $V_2$, and $V_3$, etc., are the values of the $V(\lambda)$ function at the central wavelength of each interval, and K is a constant. If K is set to a value of 683 and P is the radiance in watts per steradian per square meter, then L represents luminance in units of candelas per square meter ($cd/m^2$).

The "chromaticity" of a given visual stimulus refers generally to the perceived color of the stimulus. A "spectral" color is often considered as a perceived color that can be correlated with a specific wavelength of light. The perception of a visual stimulus having multiple wavelengths, however, generally is more complicated; for example, in human vision it is found that many different combinations of light wavelengths can produce the same perception of color.

Chromaticity is sometimes described in terms of two properties, namely, "hue" and "saturation." Hue generally refers to the overall category of perceivable color of the stimulus (e.g., purple, blue, green, yellow, orange, red), whereas saturation generally refers to the degree of white which is mixed with a perceivable color. For example, pink may be thought of as having the same hue as red, but being less saturated. Stated differently, a fully saturated hue is one with no mixture of white. Accordingly, a "spectral hue" (consisting of only one wavelength, e.g., spectral red or spectral blue) by definition is fully saturated. However, one can have a fully saturated hue without having a spectral hue (consider a fully saturated magenta, which is a combination of two spectral hues, i.e., red and blue).

A "color model" that describes a given visual stimulus may be defined in terms based on, or in some way related to, luminance (perceived strength or brightness) and chromaticity (hue and saturation). Color models (sometimes referred to alternatively as color systems or color spaces) can be described in a variety of manners to provide a construct for categorizing visual stimuli as well as communicating information to and from color devices regarding different colors. Some examples of conventional color spaces employed in the relevant arts include the RGB (red, green, blue) space (often used in conventional computer environments for "additive" color devices, such as displays, monitors, scanners, and the like) and the CMY (cyan, magenta, yellow) space (often used for "subtractive" mixing devices employing inks or dyes, such as printers). Some other examples of color constructs include the HSI (hue, saturation, intensity) model, the YIQ (luminance, in-phase, quadrature) model, the Munsell system, the Natural Color System (NCS), the DIN system, the Coloroid System, the Optical Society of America (OSA) system, the Hunter Lab system, the Ostwald system, and various CIE coordinate systems in two and three dimensions (e.g., CIE x,y; CIE u',v'; CIELUV, CIELAB).

For purposes of illustrating some exemplary color systems, the CIE x,y coordinate system is discussed initially in detail below. It should be appreciated, however, that the concepts disclosed herein generally are applicable to any of a variety of color models, spaces, or systems.

One example of a commonly used model for expressing color is illustrated by the CIE chromaticity diagram shown in FIG. 1, and is based on the CIE color system. In one implementation, the CIE system characterizes a given visual stimulus by a luminance parameter Y and two chromaticity coordinates x and y that specify a particular point on the chromaticity diagram shown in FIG. 1. The CIE system parameters Y, x and y are based on the SPD of the stimulus, and also take into consideration various color sensitivity functions which correlate generally with the response of the human eye.

More specifically, colors perceived during photopic response essentially are a function of three variables, corresponding generally to the three different types of cone receptors in the human eye. Hence, the evaluation of color from SPD may employ three different spectral weighting functions, each generally corresponding to one of the three different types of cone receptors. These three functions are referred to commonly as "color matching functions," and in the CIE systems these color matching functions typically are denoted as $\bar{x}(\lambda)$,$\bar{y}(\lambda)$,$\bar{z}(\lambda)$. Each of the color matching functions $\bar{x}(\lambda)$, $\bar{y}(\lambda)$,$\bar{z}(\lambda)$ may be applied individually to the SPD of a visual stimulus in question, in a manner similar to that discussed above in Eq. (1) above (in which the respective components $V_1$, $V_2$, $V_3$ . . . of $V(\lambda)$ are substituted by corresponding components of a given color matching function), to generate three corresponding CIE "primaries" or "tristimulus values," commonly denoted as X, Y, and Z.

As mentioned above, the tristimulus value Y is taken to represent luminance in the CIE system and hence is commonly referred to as the luminance parameter (the color matching function $\bar{y}(\lambda)$ is intentionally defined to match the photopic response function $V(\lambda)$, such that the CIE tristimulus value Y=L, pursuant to Eq. (1) above). Although the value Y correlates with luminance, the CIE tristimulus values X and Z do not substantially correlate with any perceivable attributes of the stimulus. However, in the CIE system, important color attributes are related to the relative magnitudes of the tristimulus values, which are transformed into "chromaticity coordinates" x, y, and z based on normalization of the tristimulus values as follows:

$$x=X/(X+Y+Z)$$

$$y=Y/(X+Y+Z)$$

$$z=Z/(X+Y+Z).$$

Based on the normalization above, clearly x+y+z=1, so that only two of the chromaticity coordinates are actually required to specify the results of mapping an SPD to the CIE system.

In the CIE chromaticity diagram shown in FIG. 1, the chromaticity coordinate x is plotted along the horizontal axis, while the chromaticity coordinate y is plotted along the vertical axis. The chromaticity coordinates x and y depend only on hue and saturation, and are independent of the amount of luminous energy in the stimulus; stated differently, perceived colors with the same chromaticity, but different luminance, all map to the same point x,y on the CIE chromaticity diagram. The vertical axis gives an approximate indication of the proportion of green in a given color, while the horizontal axis moves from blue on the left to red on the right.

The curved line 50 in the diagram of FIG. 1 serving as the upper perimeter of the enclosed area indicates all of the spectral colors (pure wavelengths) and is often referred to as the "spectral locus" (the wavelengths along the curve are indicated in nanometers). Again, the colors falling on the line 50 are by definition fully saturated colors. The straight line 52 at the bottom of the enclosed area in the diagram, connecting the blue (approximately 420 nanometers) and red (approximately 700 nanometers) ends, is referred to as the "purple boundary" or the "line of purples." This line represents colors that cannot be produced by any single wavelength of light; however, a point along the purple boundary nonetheless may be considered to represent a fully saturated color. The area bounded by the spectral locus 50 and the purple boundary 52 represents the full "color gamut" of human vision.

In FIG. 1, an "achromatic point" E is indicated at the coordinates x=y=⅓, representing full spectrum white. Hence, colors generally are deemed to become less saturated as one moves from the boundaries of the enclosed area toward the point E. FIG. 2 provides another illustration of the chromaticity diagram shown in FIG. 1, in which approximate color regions are indicated for general reference, including a region around the achromatic point E corresponding to generally perceived white light.

White light often is discussed in terms of "color temperature" rather than "color;" the term "color temperature" essentially refers to a particular subtle color content or shade (e.g., reddish, bluish) of white light. The color temperature of a given white light visual stimulus conventionally is characterized according to the temperature in degrees Kelvin (K) of a black body radiator that radiates essentially the same spectrum as the white light visual stimulus in question. Black body radiator color temperatures fall within a range of from approximately 700 degrees K (generally considered the first visible to the human eye) to over 10,000 degrees K; white light typically is perceived at color temperatures above 1500-2000 degrees K. Lower color temperatures generally indicate white light having a more significant red component or a "warmer feel," while higher color temperatures generally indicate white light having a more significant blue component or a "cooler feel."

FIG. 3 shows a lower portion of the chromaticity diagram of FIG. 2, onto which is mapped a "white light/black body curve" 54, illustrating representative CIE coordinates of a black body radiator and the corresponding color temperatures. As can be seen in FIG. 3, a significant portion of the white light/black body curve 54 (from about 2800 degrees K to well above 10,000 degrees K) falls within the region of the CIE diagram generally identified as corresponding to white light (the achromatic point E corresponds approximately to a color temperature of 5500 degrees K). As discussed above, color temperatures below about 2800 degrees K fall into regions of the CIE diagram that typically are associated with "warmer" white light (i.e., moving from yellow to orange to red).

The CIE chromaticity diagram may be used to evaluate a given color device's capability for reproducing various colors (i.e., specify an overall range of colors that may be generated or rendered by the device). While the entirety of the CIE chromaticity diagram represents the full color gamut of human vision, color devices generally are only able to reproduce some limited portion of this full gamut. Furthermore, different types of color devices may be configured to reproduce a range of colors that fall within different limited portions of the full gamut. Hence, a given color device typically may be associated with its own limited "device color gamut" on the CIE chromaticity diagram.

To evaluate a device color gamut associated with a given color device, an understanding of how the device reproduces different colors, and how different colors are communicated to and from the device (e.g. a data format for color commands, files, etc.), is helpful. First, it should be appreciated that conventional color devices in a computer environment (e.g., scanners, digital cameras, monitors, TV screens, film printers, printers, offset presses) often treat different perceivable colors in terms of relative amounts of "primaries" by which the device reproduces or categorizes a specific desired color, via additive or subtractive mixing of the primaries.

For example, devices such as TV screens, monitors, displays, digital cameras, and the like reproduce different colors based on additive color mixing principles. Additive color devices often employ red, green and blue primaries; hence, red, green and blue commonly are referred to as "additive primaries." These three primaries roughly represent the respective spectral sensitivities typical of the three different types of cone receptors in the human eye (having peak sensitivities at approximately 650 nanometers for red, 530 nanometers for green, and 425 nanometers for blue) under photopic conditions. Much research has shown that additive mixtures of red, green and blue primaries in different proportions can create a wide range of colors discernible to humans. This is the well-known principle on which many color displays are based, in which a red light emitter, a blue light emitter, and a green light emitter are energized in different proportions to create a wide variety of perceivably different colors, as well as white light, based on additive mixing of the primaries.

Other devices such as printers typically rely on subtractive mixing principles (e.g., mixing of inks or dyes) and generate different colors based on variants of "subtractive primaries" such as cyan, magenta, yellow, and black. In subtractive mixing, light passes through or reflects off of another medium (e.g., ink on a printed surface, paint on a wall, a dye in a filter) and is absorbed or reflected depending on particular spectral characteristics of the medium. Accordingly, in subtractive devices, different primaries of inks, dyes, gels and filters are employed to generated desired colors, based on one of the primaries or combinations of multiple primaries, that subtract out (absorb) undesired colors and let the desired color pass through.

In terms of the CIE color system, each different primary of a color device may be mapped to a corresponding point on the CIE chromaticity diagram, thereby determining a device gamut, i.e., a region of the diagram that specifies all of the possible colors that may be reproduced by the device. For additive devices employing three primaries, the device gamut is defined as a triangle formed by the x, y chromaticity coordinates corresponding to each of the red, green and blue (RGB) primaries. Printers, whose colors are based on variants of CMYK (cyan, magenta, yellow, black) subtractive primaries, have gamuts whose shape is more complex than a simple triangle, often somewhat pentagonal or hexagonal with additional vertices at the cyan, magenta, and yellow primaries, and generally smaller than gamuts based on RGB additive primaries. Again, any colors inside a device gamut can be reproduced by the device; colors outside the device gamut cannot (such colors are considered "out of gamut" for the device).

To illustrate an exemplary determination of device gamut based on the CIE chromaticity diagram, an RGB additive device, such as a computer monitor, is considered. First, a spectral power distribution (SPD) is obtained for each of the primaries of the device. In many conventional monitors, the SPDs of the primaries are determined in large part by the phosphors used, which often are chosen based on brightness, longevity, low cost and low toxicity ("ideal phosphors", i.e., with radiant dominant wavelengths located near 650 nanometers, 530 nanometers and 425 nanometers, don't exist). As will become evident in the discussion below, the choice of materials used for device primaries has perhaps the most notable effect on the resulting device gamut, based on the corresponding SPDs of the primaries.

In constructing a device gamut, typically, each of the primary SPDs is considered at a "maximum contribution level" for the primary (e.g., a maximum available radiant power). Thus, in the example of the RGB monitor, a red SPD, a green SPD and a blue SPD are obtained, each at maximum available radiant power. Subsequently, CIE chromaticity coordinates x,y are calculated for each SPD in the manner described above in connection with FIG. 1 (i.e., using the color matching functions to obtain tristimulus values X, Y, and Z, and then normalizing), and the calculated coordinates are plotted as points on the CIE chromaticity diagram.

FIG. 4 illustrates the CIE chromaticity diagram of FIG. 1, onto which are mapped exemplary x,y chromaticity coordinates generally indicative of red, green and blue primaries of a conventional RGB monitor. The resulting three points 60R, 60G and 60B form an enclosed area (i.e., triangle) constituting the device gamut 60 for the monitor. It may be appreciated from FIG. 4 that the exemplary monitor device gamut 60 is quite limited with respect to the full gamut of human vision, in that it maintains a notable distance from the purple boundary 52 and generally excludes a significant portion of the green and cyan regions of the CIE chromaticity diagram.

The particular device gamut 60 shown in FIG. 4 represents a color space commonly referred to in the relevant arts as "sRGB" (or "standard" RGB). The sRGB color space was created cooperatively by Hewlett-Packard and Microsoft Corporation, and is endorsed and employed ubiquitously by many other computer-related color industry participants for both hardware and software purposes relating to color reproduction (it is the defacto standard for the Internet and the Windows operating system). The specific CIE chromaticity coordinates for the sRGB color space are defined as [0.6400, 0.3300] for the red vertex 60R, [0.3000, 0.6000] for the green vertex 60G, and [0.1500, 0.0600] for the blue vertex 60B. A "white point" for the sRGB space, corresponding to a color temperature of approximately 6500 degrees K, also is defined as [0.3127, 0.3290] and labeled as "D65" in FIG. 4 (the sRGB white point is slightly different than the achromatic white point E in FIGS. 1-3, which has CIE x,y coordinates of [0.33, 0.33]).

For purposes of comparison, an exemplary CMYK (cyan, magenta, yellow, black) color space, typically represented by a device gamut for subtractive devices such as printers, also is shown in FIG. 4 as the gamut 62. As discussed above, subtractive devices generally have gamuts whose shape is more complex than a simple triangle. Most four-color CMYK printers have device gamuts generally smaller than the sRGB color space (high quality inkjet printers with more than four colors, typically with the addition of light C and light M, may have somewhat larger gamuts than the gamut 62 shown in FIG. 4).

Various color devices often identify different reproducible colors based on a data format that specifies relative amounts of different primaries. For example, devices employing red, green and blue primaries such as the monitor represented by the sRGB color space shown in FIG. 4 often reproduce different colors based on an [R, G, B] data format, wherein each of the R, G, and B values ranges from zero to some maximum value (representing a "full output" for that primary). For example, in 24-bit RGB color spaces, color is described by three 8-bit bytes, each of which can take on values from zero through 255. Accordingly, a color represented by only the red primary is designated as [255, 0, 0], a color represented by only the green primary is designated as [0, 255, 0], and a color represented by only the blue primary is designated as [0, 0, 255]; other colors are designated in terms of relative amounts of the primaries. In this format, black is designated as [0, 0, 0], and "pure" white (corresponding to the "white point" of a given device) is designated as [255, 255, 255]. Some computer programs utilize 48-bit RGB color that allows values of 0 through 65,536 for each primary color (16 bits/color).

It should be appreciated, however, that the numeric values in any given data format for color have no clear, unambiguous meaning unless they are associated with a particular color space (i.e., a particular gamut). Specifically, for the primary values to have any significance with respect to reproducing a particular color in a given device, each value must be associated with a corresponding vertex of the particular gamut associated with the device or a gamut representing some predetermined (e.g., industry standardized or specified) color space, such as the sRGB color space shown in FIG. 4. Stated differently, using the example of an [R, G, B] format, the same [R, G, B] values associated with two different color gamuts or spaces generally will reproduce different perceivable colors.

To emphasize this concept, an example of a specific transform to map an arbitrary [R, G, B] data set to a specific color space defined on the CIE chromaticity diagram is presented below. This process relates significantly to the CIE tristimulus values determined for each of the different primaries; in essence, it is the specific choice of primaries that determines the color space. In particular, in calculating the x,y chromaticity coordinates for the respective primaries of a given color space (e.g., the points 60R, 60G and 60B shown in FIG. 4), as discussed above in connection with FIG. 1 each primary is associated (via the color matching functions $\bar{x}(\lambda),\bar{y}(\lambda),\bar{z}(\lambda)$) with a corresponding set of CIE tristimulus values X, Y, and Z. A matrix transformation may be derived, based on the three sets of tristimulus values, to map an arbitrary [R, G, B] data set representing a desired color to a corresponding set of tristimulus values according to:

$$\begin{bmatrix} X_R & X_G & X_B \\ Y_R & Y_G & Y_B \\ Z_R & Z_G & Z_B \end{bmatrix} \begin{bmatrix} R \\ G \\ B \end{bmatrix} = \begin{bmatrix} X \\ Y \\ Z \end{bmatrix}. \tag{2}$$

In Eq. (2), the R-G-B column vector is the data set representing the prescribed relative amounts of the respective primaries to generate a desired color. Each column of the three-by-three transformation matrix represents the tristimulus values for one of the primaries at its maximum possible value in the [R, G, B] data set (e.g., $X_R$, $Y_R$, and $Z_R$ represent the tristimulus values for the red primary at maximum output, wherein $Y_R$ represents the maximum luminance from the red primary). In this manner, it is the transformation matrix that defines the particular color space. Finally, the column vector X-Y-Z in Eq. (2) represents the resulting CIE tristimulus values of the desired color corresponding to the arbitrary ratio specified in the [R, G, B] data set, wherein Y represents the luminance of the desired color. Hence, according to the transformation given in Eq. (2) above, any arbitrary color based on relative proportions of the red, green and blue primaries may be mapped to the CIE tristimulus values, which in turn are normalized and mapped to the chromaticity diagram, falling within or along the perimeter of the gamut representing the color space defined by the transformation matrix.

In view of the foregoing, it should be appreciated that the sRGB color space illustrated in FIG. 4 corresponds to a particular transformation (i.e., particular values for the nine matrix elements) operating on an [R, G, B] data set. This particular transformation was based on the primaries found in conventional CRT monitors (dating back to approximately 1996). Vast amounts of software (both professional and personal computer software) assume the sRGB color space for color reproduction; namely, that an image file employing a 24-bit [R, G, B] color data format (i.e., 8 bits/primary), placed unchanged into the buffer of a display or monitor, will display colors predictably based on predetermined combinations of the particular sRGB primaries.

However, the practical reality in computer environments is that, as discussed above, different color devices do not necessarily have device gamuts that are identical or similar to the sRGB color space. One reason for this is that one or more of the red, green and blue primaries in one device may not have exactly or even substantially the same spectral power distribution (and hence corresponding X, Y, Z tristimulus values) as the corresponding red, green and blue primaries of another device, thus leading to different transformation matrices in Eq. (2) above. This means that the same [R, G, B] values may produce notably different colors in different devices that do not share a common color space. Furthermore, different devices may reproduce color based on different primaries, and/or based on different primary mixing techniques; as discussed above, output devices such as printers typically are based on subtractive mixing of CMY(K) primaries.

Dealing with the foregoing situation is referred to as "color management." Maintaining consistent color appearance in the translation between different color devices and color spaces in many cases is not trivial, but color management techniques generally provide a reasonably sane and practical solution. At present, however, often the most sophisticated color management system is unable to make two color devices with different gamuts display exactly the same set of colors; in most cases, a reasonable approximation is the best available solution.

FIG. 5 illustrates the general concept of color management in terms of a "color-managed workflow" in a conventional computer peripheral environment that includes a scanner, a monitor, a color printer, and one or more color image files. In some exemplary computer environments, computer programs that implement color management concepts often are described as being "ICM-aware," wherein ICM stands for Image Color Management. ICM standards are maintained by the International Color Consortium (ICC), which was formed in 1993 by a number of computer industry vendors to create a universal color management system that would function transparently across many operating systems and software packages. The ICC specification allows for fidelity of color when color identifiers are moved between applications and operating systems, from the point of creation to final reproduction.

In a color-managed workflow similar to that shown in FIG. 5, the color response of each device and each color image file (i.e., the device gamut or color space defined for the device or image file) is characterized by a file called an "ICC profile." ICC profiles may exist as "stand-alone" computer files (ICC profiles generally have the extension ".icm," and in the Windows operating systems are stored in specific directories). ICC profiles also may be embedded as tags within color image files; for example, the image file types TIFF, JPEG, PNG, and BMP are supported by most ICM-aware image editors. The ICC specification divides color devices into three broad classifications: input devices, display devices, and output devices. In the example of FIG. 5, four ICC profiles are illustrated, namely, a scanner ICC profile 72 (input device), an image-embedded ICC profile 74 (e.g., from a digital camera, also an input device) , a monitor ICC profile 76 (display device), and a printer ICC profile 78 (output device).

ICC profiles are configured to relate numeric data specifying a desired color in one color space (e.g., values expressing relative amounts of primaries, such as [R, G, B]), to a corresponding color expressed in a device-independent "Profile Connection Space (PCS)" (also referred to as a "working color space"). The PCSs currently relied upon for ICC profiles include either the CIE-XYZ or CIELAB color spaces. An exemplary PCS common to the computer environment of FIG. 5 is indicated in block 70.

The heart of color management is the translation or "gamut mapping" between devices with different color gamuts and files with different color spaces. In particular, an ICC profile for a color device (e.g., the scanner profile 72, the monitor profile 76, and the printer profile 78) contains data that defines a mapping between the device's color space and the PCS 70. Similarly, an ICC profile for a color image file (e.g., the image-embedded ICC profile 74) contains data that defines a mapping between the color space in which the color image was created and the PCS 70.

From the foregoing, it should be appreciated that the integrity of the mapping data in a given ICC profile determines in significant part the degree of success in color reproduction in a color-managed workflow process. Because colors may be perceived in a wide variety of viewing environments and/or on a wide variety of imaging media, a standard viewing environment for the PCS also is defined in the ICC specification based on the ISO 13655 standard. One of the first steps in profile building involves measuring a set of colors from some imaging media or display; i.e., measuring the primaries that ultimately define the color space for the image or color device. If the imaging media or viewing environment in which the primaries are measured differ from the ICC standard viewing environment defined for the PCS, it is necessary to adapt the calorimetric data for the primaries to the ICC standard (typically, it is the responsibility of the profile builder to do any required adaptation.

A variety of industry vendors provide products and services for facilitating the creation of device and image profiles for color-managed workflow processes. One example of such a vendor is Gretag-Macbeth of Switzerland (see http://www-.gretagmacbeth.com). Gretag-Macbeth provides a series of products for reading color from a variety of sources, and creating and editing ICC profiles for such sources, including a variety of monitors (CRT, LCD, laptop displays), digital projectors, digital studio cameras, and RGB, CMYK, Hexachrome, CMYK+Red/Blue and CMYK+Red/Green output devices. Profiles can be edited for fine tuning based on deviations of measured colors from the ICC standard viewing environment. Additionally, "spot colors" representing a variety of vendor-defined colors such as Pantone or Munsell colors, may be defined the in the PCS for reproduction on a target device (to the extent possible based on the target device's gamut). Virtually any color can be scanned from any source to create a color library (e.g., the entire Pantone library), and custom color palettes may be created from scanned sources.

FIG. 6 illustrates a color management source-target gamut mapping process. A "color matching module" (CMM), also sometimes referred to as a "color engine" 80, is a program that uses the data in any two ICC profiles to perform a complete mapping from a color source to a color target. Specifically, the color engine 80 utilizes a source ICC profile (e.g., one of the profiles 72 and 74 shown in FIG. 5) and a target ICC profile (e.g., one of the files 76 and 78 in FIG. 5), both of which are referenced to the PCS 70, to convert source color data 82 to target color data 84 (i.e., perform a direct conversion between the source and target color spaces).

For example, the color engine 80 may receive source color data 82 from a scanner in RGB space and provide target color data for a printer in CMYK space. In so doing, the color engine first converts source color data from the scanner in the form [R, G, B] to the PCS (e.g., CIE x, y coordinates and a Y parameter) based on the data contained in the scanner ICC profile 72. Subsequently, the color engine 80 converts the color as designated in the PCS, based on the data contained in the printer ICC profile 78, to target color data in the form [C, M, Y, K] which is output to the printer. In various implementations, the color engine may accomplish the gamut mappings via interpolation of numeric data stored in tables in the ICC profiles, or through a series of algorithmic transformations acting on the numeric data stored in ICC profiles. A color engine also may be employed to simply recreate one or more colors defined in the PCS on a target output or display color device, based on the target ICC profile for the device. For example, FIG. 6 also illustrates a color library 86 that defines one or more colors in terms of the PCS. A user interface 88 (e.g., a computer graphics user interface or "GUI") may be utilized to select one or more colors from the color library 86, and the color engine provides corresponding target color data 84 to the target device so as to reproduce (or approximate) one or more selected colors from the color library.

While the format of ICC profiles is defined precisely, the algorithms and processing details performed by the color engine 80 on the ICC profiles are not strictly defined, allowing for some variation amongst different applications and systems employing different color engines. Some examples of color engines found in conventional computer environments include Windows' ICM 2.0, Adobe Photoshop's ACE, and Apple's ColorSync.

In some instances, the mappings performed by a color engine can be quite complex, especially when the source and target color spaces are significantly different. In this situation, a color engine may be configured to perform gamut mapping with one of four "rendering intents" recognized by the ICC standard. Specifically, a given rendering intent determines how colors are handled if they are present in the source color data but are "out of gamut" in the target color space (beyond the color reproduction capability of the target device); for this reason, each rendering intent represents some kind of compromise. FIG. 7 illustrates some of the general concepts underlying rendering intents; there are several nomenclatures used in the industry for various rendering intents, and for the present discussion the standard ICC nomenclature is used.

In "perceptual" rendering, a color engine is configured to perform an expansion or compression when mapping between different source and target color spaces, so as to maintain consistent overall appearance. This rendering intent is generally recommended for processing photographic sources. Via perceptual rendering, low saturation colors are changed very little whereas more saturated colors within the gamuts of both color spaces may be altered to differentiate them from saturated colors outside the smaller gamut color space. Algorithms implementing perceptual rendering can be quite complex. On the right side of FIG. 7, perceptual rendering is conceptually depicted; source and target color spaces are indicated as rectangular blocks, in which the left and right sides of the blocks represent saturated colors and the middle of the blocks represents neutral gray. Perceptual rendering applies the same gamut compression to all images, even when the image contains no significant out-of-gamut colors. Perceptual rendering is mostly reversible, and generally is most accurate in 48-bit color devices.

None of the other three rendering intents is reversible. In "relative colorimetric" rendering, a color engine is configured to reproduce in-gamut colors exactly and clip out-of-gamut colors to the nearest reproducible hue. This type of rendering is conceptually depicted on the left side of FIG. 7. In "absolute calorimetric" rendering, in-gamut colors are reproduced exactly and out-of-gamut colors are clipped to the nearest reproducible hue, sacrificing saturation and possibly lightness. In this type of rendering, on tinted papers, whites may be darkened to keep the hue identical to the original. For example, cyan may be added to the white of a cream-colored paper, effectively darkening the image. Finally, in "saturation rendering," saturated primary colors in the source are mapped to the closest saturated primary colors in the target, neglecting differences in hue, saturation, or lightness.

In sum, the concept of color management in computer environments has two key features. First, color devices or color images are each associated with a "color management profile" (e.g., an ICC profile) that defines a mapping between a device gamut (e.g., associated with a scanner, printer, monitor, digital camera, etc.) or a color space (e.g., associated with a digital image) and a common "working color space" (e.g., a "profile connection space" or PCS). Second, a color matching module (CMM), or "color engine," uses the information in the color management profiles to perform a mapping between a source gamut or color space to a target gamut or color space, via the intermediary of the working color space (e.g., the PCS). Some of the challenging details of color management include selecting an appropriate rendering intent implemented by a color engine to achieve the most reasonable color rendition for a given mapping.

While the discussion above regarding color management focused on the CIE XYZ color space as a working color space (profile connection space), it should be appreciated that a variety of color models, color spaces, or color systems may be used as a working color space in a color-managed workflow. For example, in Microsoft Windows and Microsoft Office products, every driver for an input color device makes a color transformation from the color space of the device to sRGB space; for an output device or monitor, the associated driver then makes a color transformation from sRGB space to the color space of the output device. Hence, in the Microsoft implementation of color management, the sRGB space serves as the working color space. Other vendors, such as Apple, implement color management techniques via the ICC specification discussed above, and utilize one of the CIE color systems as a profile connection space. In particular, Apple's ColorSync color engine is fully integrated into the Mac operating system and fully supports ICC standards for managing color.

Also, while the ICC profile specification was discussed as one important component of an exemplary color-managed workflow, it should be appreciated that other color management approaches exist specifying profile formats (e.g., OpenEXR Color Management Proposal, IQA) and design of color matching modules or color engines. Finally, it should also be appreciated that different aspects of color management may be implemented in an operating system, by applications running in an operating system, and/or in color devices themselves.

SUMMARY

Applicants have recognized and appreciated that the concept of color management and color-managed workflow may be applied to lighting apparatus configured to generate multicolored light, including lighting apparatus based on LED sources. Accordingly, various embodiments of the present disclosure are directed to color management methods and apparatus for lighting devices.

In various embodiments, color management principles may be employed to facilitate the generation of variable color light (or variable color temperature white light) from one or more lighting apparatus based on any of a number of possible input specifications for a desired color. For example, in one embodiment, a transformation between an arbitrary input specification for a desired color and a lighting command processed by a given lighting apparatus is accomplished via the use of a source color management profile for the input specification of the desired color, a target color management profile for the lighting apparatus, and a common working color space.

In various aspects, the common working color space may be the CIE XYZ color space or a variety of other color spaces. Similarly, the color management profiles for the input specification of the desired color and the lighting device may be ICC profiles, or color management profiles having other formats. In other aspects, the input specification for a desired color may be based on a computer input peripheral (e.g., a scanner, a digital camera, etc.) or a digital color image file. In another aspect, one or more commercial (vendor-specified) colors, such as a Pantone, Munsell, Rosco, Lee or GAM colors, may be specified in the working color space and recreated or approximated (e.g., pursuant one or more rendering intents) on one or more lighting apparatus based on a target color management profile. In another aspect, the target color management profile for a given lighting apparatus may be based on a target color space representing the device gamut for the lighting apparatus, or a reference color gamut common to multiple lighting apparatus (e.g., a predetermined industry-specified color space). In yet another aspect, the target color management profile may be based on a target color space derived from a model of a surface illuminated by one or more lighting apparatus.

In sum, one embodiment of the present disclosure is directed to a color-managed illumination system, comprising at least one lighting unit. The at least one lighting unit comprises at least one first LED configured to generate first light having a first spectrum, at least one second LED configured to generate second light having a second spectrum different from the first spectrum, and at least one controller configured to control the first light and the second light so as to generate from the at least one lighting unit a range of colors or color temperatures of perceived light. The color-managed illumination system further comprises at least one target color management profile associated with the at least one lighting unit, the at least one target color management profile representing a first mapping from a working color space for the color-managed illumination system to a lighting unit color gamut that specifies the range of colors or color temperatures of the perceived light that can generated by the at least one lighting unit.

Another embodiment of the present disclosure is directed to a color-managed illumination method, comprising acts of: A) energizing at least one first LED to generate first light having a first spectrum; B) energizing at least one second LED to generate second light having a second spectrum different from the first spectrum; and C) controlling the first light and the second light so as to generate a range of colors or color temperatures of perceived light based at least in part on at least one target color management profile associated with at least the first spectrum and the second spectrum, the at least one target color management profile representing a first mapping from a working color space for the color-managed illumination method to a lighting color gamut that specifies the range of colors or color temperatures of the perceived light that can be generated.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, electroluminescent strips, and the like.

In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The terms "lighting unit" and "lighting fixture" are used interchangeably herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources.

The terms "processor" or "controller" are used herein interchangeably to describe various apparatus relating to the operation of one or more light sources. A processor or controller can be implemented in numerous ways, such as with dedicated hardware, using one or more microprocessors that are programmed using software (e.g., microcode) to perform the various functions discussed herein, or as a combination of dedicated hardware to perform some functions and programmed microprocessors and associated circuitry to perform other functions. Examples of processor or controller components that may be employed in various embodiments of the present invention include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present invention, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present invention include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

The following patents and patent applications are hereby incorporated herein by reference:

U.S. Pat. No. 6,016,038, issued Jan. 18, 2000, entitled "Multicolored LED Lighting Method and Apparatus;"

U.S. Pat. No. 6,211,626, issued Apr. 3, 2001, entitled "Illumination Components,"

U.S. Pat. No. 6,608,453, issued Aug. 19, 2003, entitled "Methods and Apparatus for Controlling Devices in a Networked Lighting System;"

U.S. Pat. No. 6,548,967, issued Apr. 15, 2003, entitled "Universal Lighting Network Methods and Systems;"

U.S. patent application Ser. No. 09/886,958, filed Jun. 21, 2001, entitled Method and Apparatus for Controlling a Lighting System in Response to an Audio Input;"

U.S. patent application Ser. No. 10/078,221, filed Feb. 19, 2002, entitled "Systems and Methods for Programming Illumination Devices;"

U.S. patent application Ser. No. 09/344,699, filed Jun. 25, 1999, entitled "Method for Software Driven Generation of Multiple Simultaneous High Speed Pulse Width Modulated Signals;"

U.S. patent application Ser. No. 09/805,368, filed Mar. 13, 2001, entitled "Light-Emitting Diode Based Products;"

U.S. patent application Ser. No. 09/716,819, filed Nov. 20, 2000, entitled "Systems and Methods for Generating and Modulating Illumination Conditions;"

U.S. patent application Ser. No. 09/675,419, filed Sep. 29, 2000, entitled "Systems and Methods for Calibrating Light Output by Light-Emitting Diodes;"

U.S. patent application Ser. No. 09/870,418, filed May 30, 2001, entitled "A Method and Apparatus for Authoring and Playing Back Lighting Sequences;"

U.S. patent application Ser. No. 10/045,604, filed Mar. 27, 2003, entitled "Systems and Methods for Digital Entertainment;"

U.S. patent application Ser. No. 10/045,629, filed Oct. 25, 2001, entitled "Methods and Apparatus for Controlling Illumination;"

U.S. patent application Ser. No. 09/989,677, filed Nov. 20, 2001, entitled "Information Systems;"

U.S. patent application Ser. No. 10/158,579, filed May 30, 2002, entitled "Methods and Apparatus for Controlling Devices in a Networked Lighting System;"

U.S. patent application Ser. No. 10/163,085, filed Jun. 5, 2002, entitled "Systems and Methods for Controlling Programmable Lighting Systems;"

U.S. patent application Ser. No. 10/174,499, filed Jun. 17, 2002, entitled "Systems and Methods for Controlling Illumination Sources;"

U.S. patent application Ser. No. 10/245,788, filed Sep. 17, 2002, entitled "Methods and Apparatus for Generating and Modulating White Light Illumination Conditions;"

U.S. patent application Ser. No. 10/245,786, filed Sep. 17, 2002, entitled "Light Emitting Diode Based Products;"

U.S. patent application Ser. No. 10/325,635, filed Dec. 19, 2002, entitled "Controlled Lighting Methods and Apparatus;"

U.S. patent application Ser. No. 10/360,594, filed Feb. 6, 2003, entitled "Controlled Lighting Methods and Apparatus;"

U.S. patent application Ser. No. 10/435,687, filed May 9, 2003, entitled "Methods and Apparatus for Providing Power to Lighting Devices;"

U.S. patent application Ser. No. 10/828,933, filed Apr. 21, 2004, entitled "Tile Lighting Methods and Systems;"

U.S. patent application Ser. No. 10/839,765, filed May 5, 2004, entitled "Lighting Methods and Systems;"

U.S. patent application Ser. No. 11/010,840, filed Dec. 13, 2004, entitled "Thermal Management Methods and Apparatus for Lighting Devices;"

U.S. patent application Ser. No. 11/079,904, filed Mar. 14, 2005, entitled "LED Power Control Methods and Apparatus;"

U.S. patent application Ser. No. 11/081,020, filed on Mar. 15, 2005, entitled "Methods and Systems for Providing Lighting Systems;"

U.S. patent application Ser. No. 11/178,214, filed Jul. 8, 2005, entitled "LED Package Methods and Systems;"

U.S. patent application Ser. No. 11/225,377, filed Sep. 12, 2005, entitled "Power Control Methods and Apparatus for Variable Loads;" and U.S. patent application Ser. No. 11/224,683, filed Sep. 12, 2005, entitled "Lighting Zone Control Methods and Systems."

It should be appreciated that all combinations of the foregoing concepts and additional concepts discussed in greater detail below are contemplated as being part of the inventive subject matter disclosed herein. In particular, all combinations of claimed subject matter appearing at the end of this disclosure are contemplated as being part of the inventive subject matter disclosed herein.

DETAILED DESCRIPTION

Figure 1:
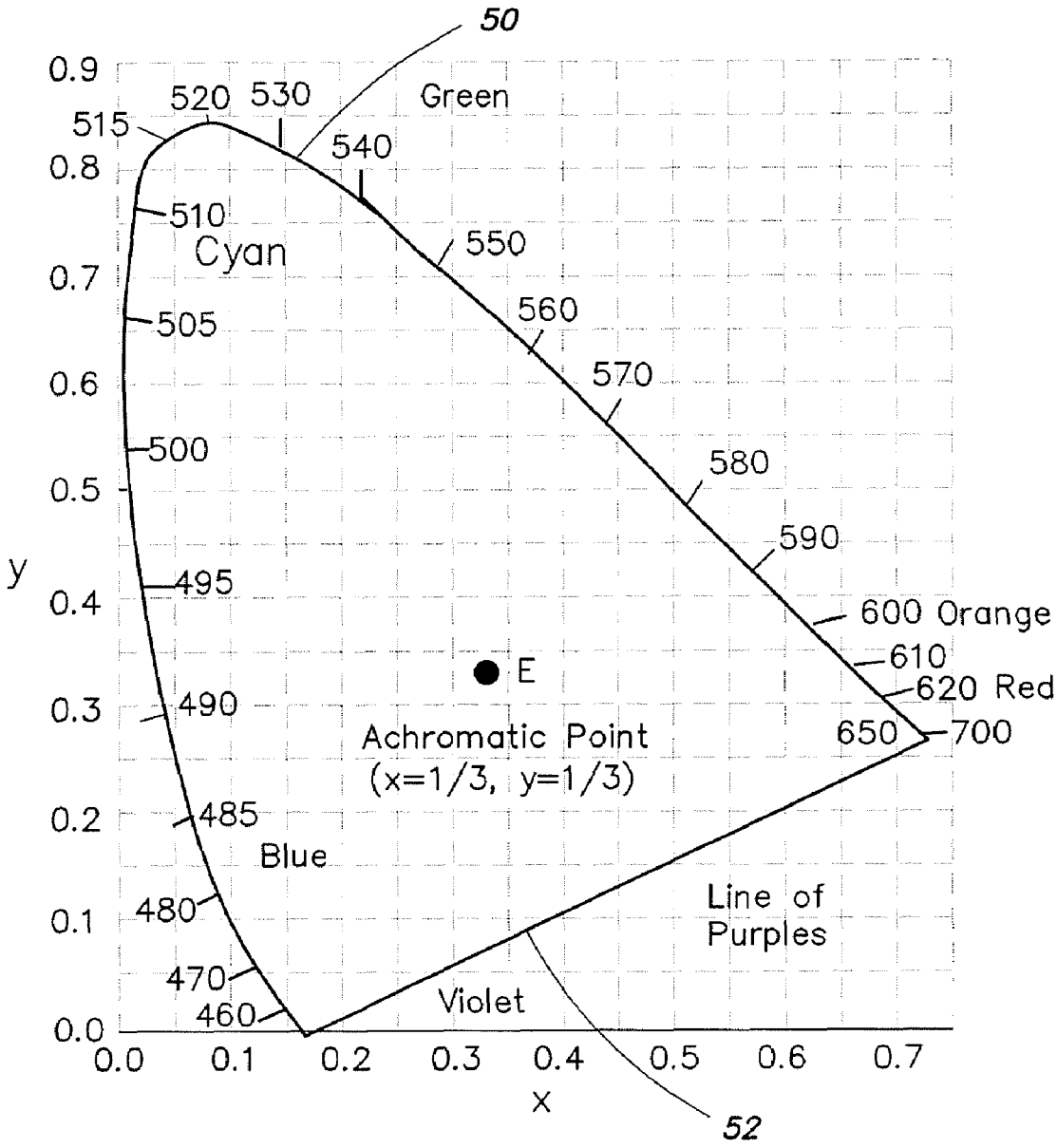
FIG. 1 PRIOR ART
FIG. 1 illustrates the conventional CIE Chromaticity Diagram.
Figure 2:
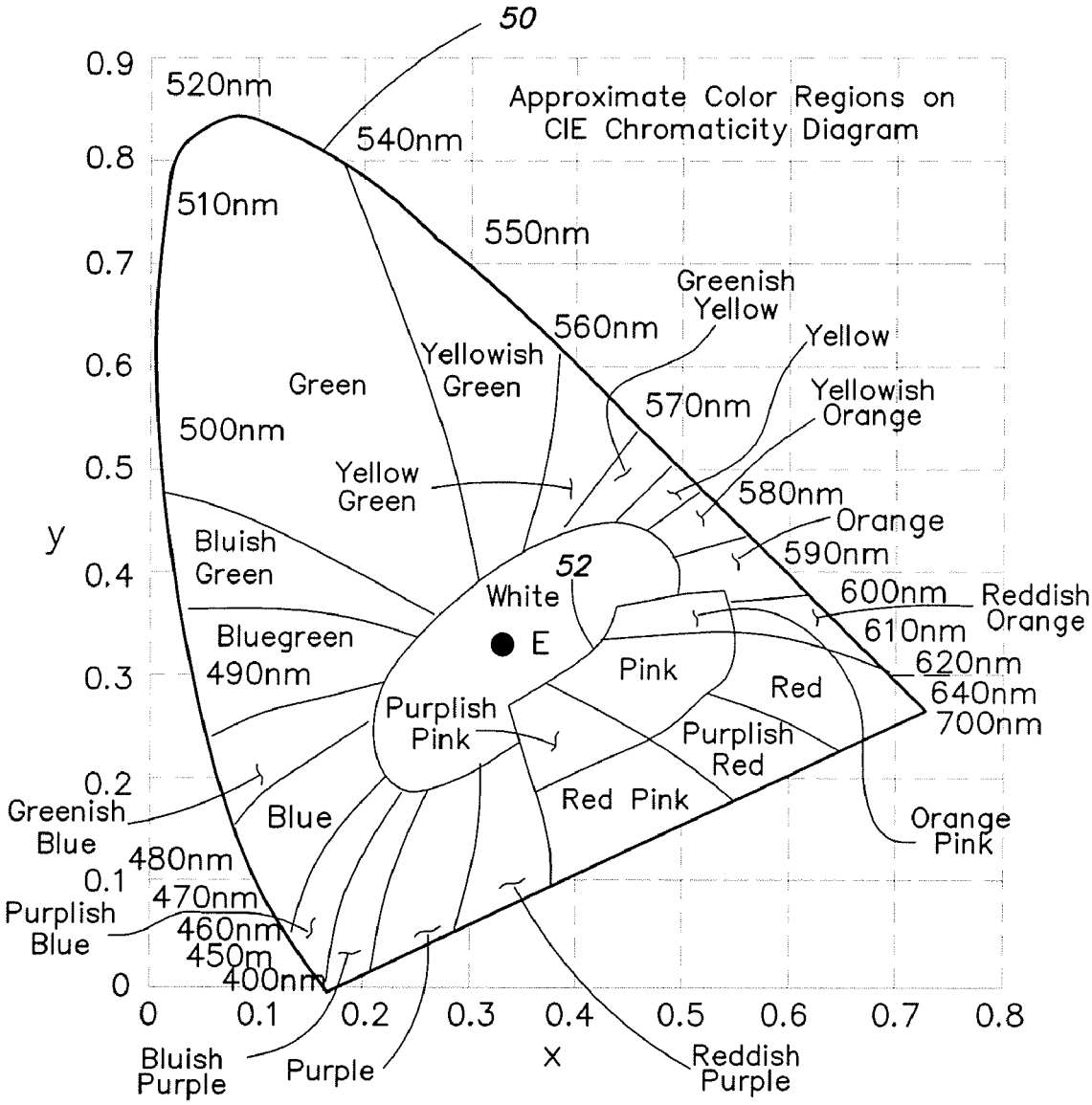
FIG. 2 PRIOR ART
FIG. 2 illustrates the diagram of FIG. 1, with approximate color categorizations indicated thereon.
Figure 3:
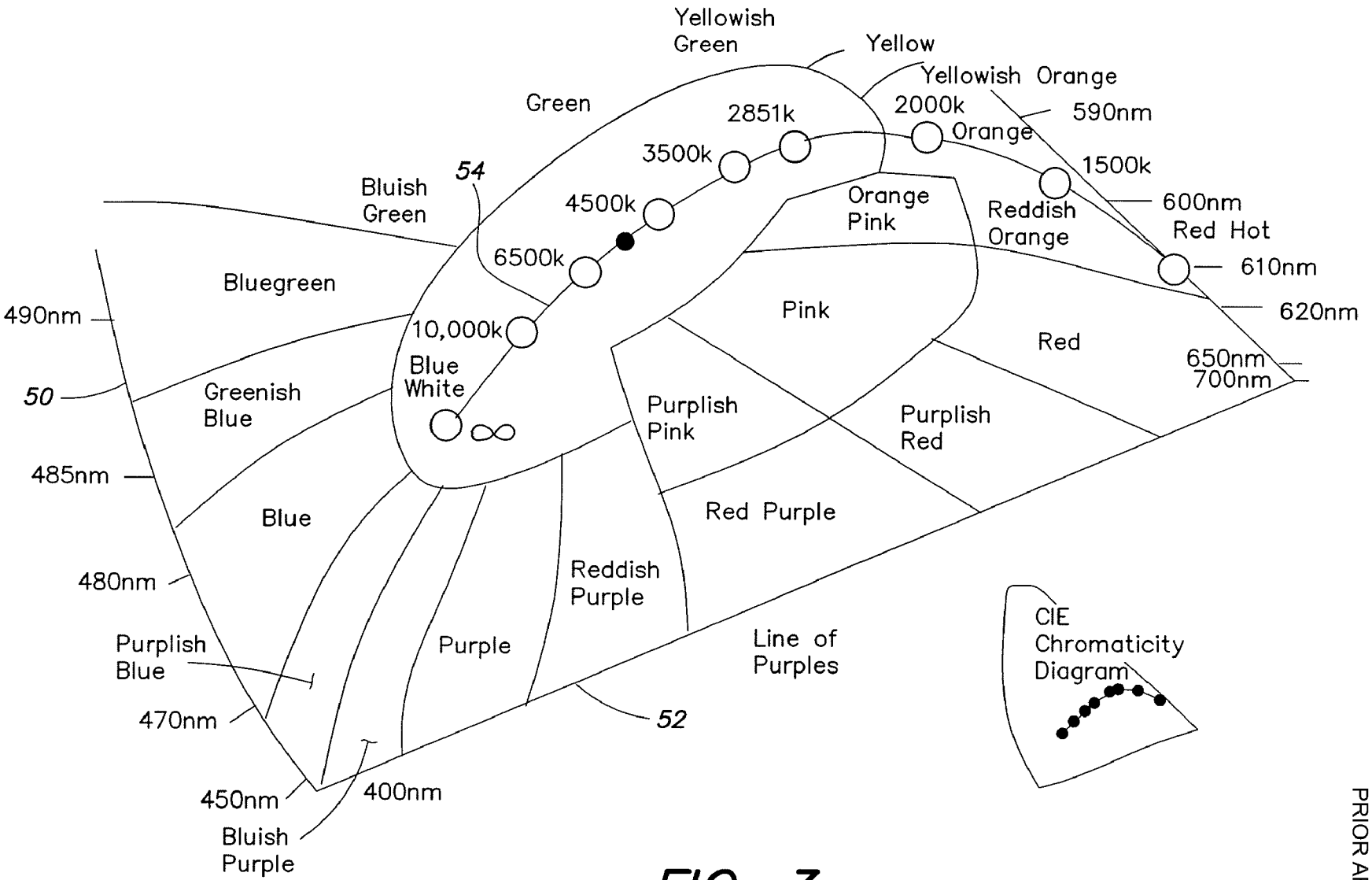
FIG. 3 illustrates a portion of the diagram of FIG. 2, onto which is mapped a white light/black body curve representing color temperatures of white light.

Various embodiments of the present disclosure are described below, including certain embodiments relating particularly to LED-based light sources. It should be appreciated, however, that the present disclosure is not limited to any particular manner of implementation, and that the various embodiments discussed explicitly herein are primarily for purposes of illustration. For example, the various concepts discussed herein may be suitably implemented in a variety of environments involving LED-based light sources, other types of light sources not including LEDs, environments that involve both LEDs and other types of light sources in combination, and environments that involve non-lighting-related devices alone or in combination with various types of light sources.

The present disclosure is directed generally to color management methods and apparatus for lighting devices/apparatus, including lighting units or fixtures based on LED sources. In various embodiments, color management principles may be employed to facilitate the generation of variable color light (or variable color temperature white light) from one or more lighting apparatus based on any of a number of possible input specifications for a desired color. For example, in one embodiment, a transformation between an arbitrary input specification for a desired color and a lighting command processed by a given lighting apparatus is accomplished via the use of a source color management profile for the input specification of the desired color, a target color management profile for the lighting apparatus, and a common working color space.

In various aspects of different embodiments, the common working color space may be the CIE XYZ color space or a variety of other color spaces. Similarly, color management profiles for the input specification of the desired color and the lighting device may be ICC profiles, or color management profiles having other formats. In other aspects, the input specification for a desired color may be based on a computer input peripheral (e.g., a scanner, a digital camera, etc.), a digital color image file, or a commercial color specification such as a Pantone, Munsell, Rosco, Lee or GAM color specification (a library of vendor-specified or custom colors may be defined in the working color space). In another aspect, the target color management profile for a given lighting apparatus may be based on a target color space representing the device gamut for the lighting apparatus, or a reference color gamut common to multiple lighting apparatus (e.g., a reference gamut that is based on a predefined industry-standard color space for a class of devices). In yet another aspect, the target color management profile may be based on a target color space derived from a model of a surface illuminated by one or more lighting apparatus.

Solid-state lighting devices (e.g., light emitting diodes, or LEDs) are employed in many lighting applications. In one exemplary implementation, to create multi-colored or white light, multiple different color LEDs may be employed to represent the primary colors (e.g., red LEDs, blue LEDs and green LEDs). Although not completely monochromatic, the radiation generated by many "colored" LEDs (i.e., non-white LEDs) characteristically has a very narrow bandwidth spectrum (e.g., a full-width at half maximum, or FWHM, on the order of approximately 5-10 nanometers). Exemplary approximate dominant wavelengths for commonly available red, green and blue LEDs include 615-635 nanometers for red LEDs, 515-535 nanometers for green LEDs, and 460-475 nanometers for blue LEDs.

Exemplary variable-color and white light generating apparatus based on LED light sources are discussed below in connection with FIGS. 8 and 9. It should be appreciated that while some exemplary apparatus are discussed herein in terms of red, green and blue LED sources, the present disclosure is not limited in this respect; namely, light generating apparatus according to various embodiments of the present disclosure may include LEDs having any of a variety of dominant wavelengths and overall spectrums (e.g., red LEDs, green LEDs, blue LEDs, cyan LEDs, yellow LEDs, amber LEDs, orange LEDs, broader spectrum white LEDs having various color temperatures, etc.)

Figure 8:
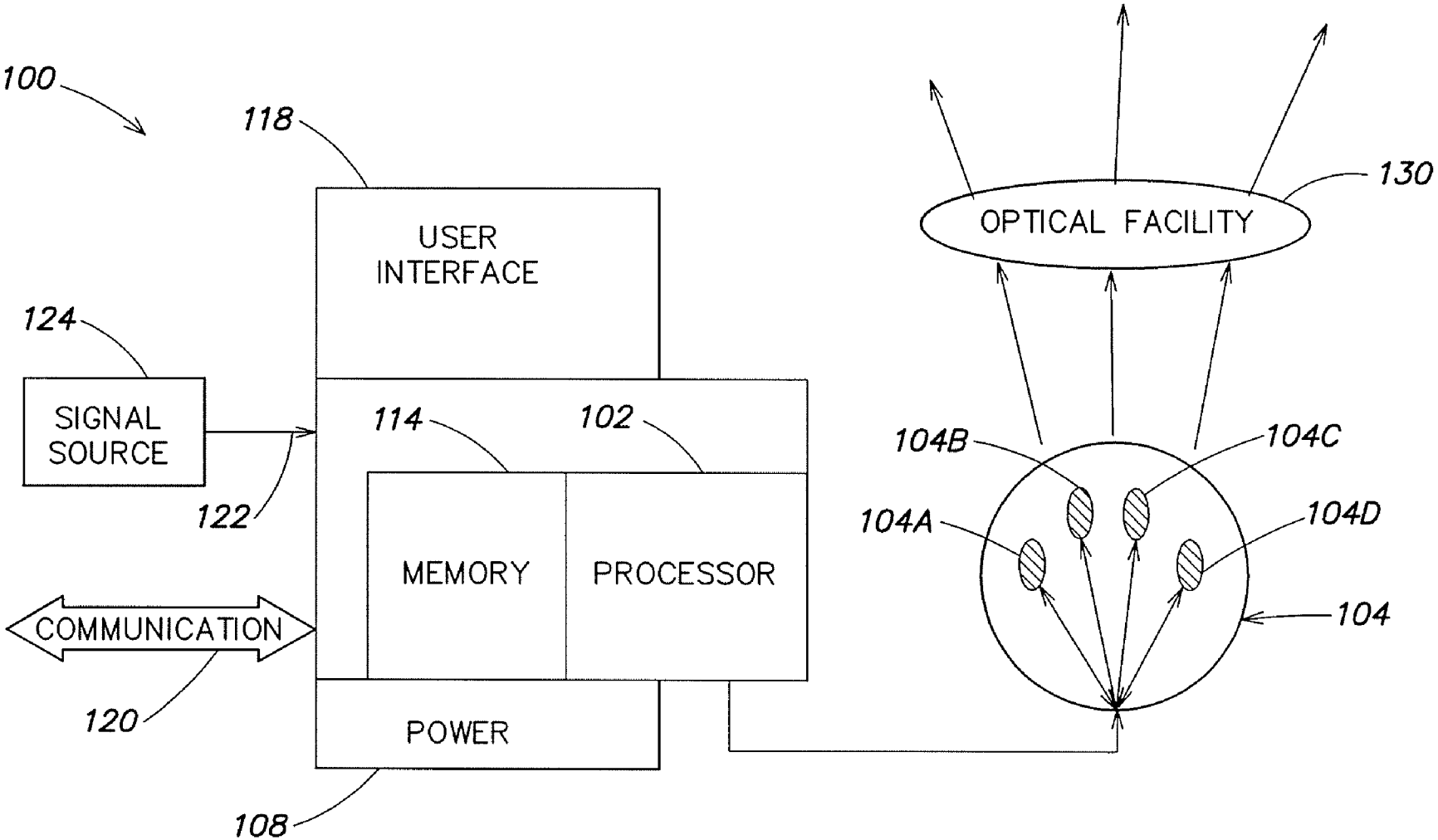
FIG. 8 is a diagram illustrating a lighting unit according to one embodiment of the disclosure.

FIG. 8 illustrates one example of a lighting unit 100 that maybe configured for use in a color-managed system, according to one embodiment of the present disclosure. Some examples of LED-based lighting units similar to those that are described below in connection with FIG. 8 may be found, for example, in U.S. Pat. No. 6,016,038, issued Jan. 18, 2000 to Mueller et al., entitled "Multicolored LED Lighting Method and Apparatus," and U.S. Pat. No. 6,211,626, issued Apr. 3, 2001 to Lys et al, entitled "Illumination Components," which patents are both hereby incorporated herein by reference.

In various embodiments of the present disclosure, the lighting unit 100 shown in FIG. 8 may be used alone or together with other similar lighting units in a system of lighting units (e.g., as discussed further below in connection with FIG. 9). Used alone or in combination with other lighting units, the lighting unit 100 may be employed in a variety of applications including, but not limited to, interior or exterior space (e.g., architectural) illumination in general, direct or indirect illumination of objects or spaces, theatrical or other entertainment-based/special effects lighting, decorative lighting, safety-oriented lighting, vehicular lighting, illumination of displays and/or merchandise (e.g. for advertising and/or in retail/consumer environments), combined illumination and communication systems, etc., as well as for various indication, display and informational purposes.

Additionally, one or more lighting units similar to that described in connection with FIG. 8 may be implemented in a variety of products including, but not limited to, various forms of light modules or bulbs having various shapes and electrical/mechanical coupling arrangements (including replacement or "retrofit" modules or bulbs adapted for use in conventional sockets or fixtures), as well as a variety of consumer and/or household products (e.g., night lights, toys, games or game components, entertainment components or systems, utensils, appliances, kitchen aids, cleaning products, etc.) and architectural components (e.g., lighted panels for walls, floors, ceilings, lighted trim and ornamentation components, etc.).

In one embodiment, the lighting unit 100 shown in FIG. 8 may include one or more light sources 104A, 104B, and 104C (shown collectively as 104), wherein one or more of the light sources may be an LED-based light source that includes one or more light emitting diodes (LEDs). In one aspect of this embodiment, any two or more of the light sources 104A, 104B, and 104C may be adapted to generate radiation of different colors (e.g. red, green, and blue, respectively). Although FIG. 8 shows three light sources 104A, 104B, and 104C, it should be appreciated that the lighting unit is not limited in this respect, as different numbers and various types of light sources (all LED-based light sources, LED-based and non-LED-based light sources in combination, etc.) adapted to generate radiation of a variety of different colors, including essentially white light, may be employed in the lighting unit 100, as discussed further below.

As shown in FIG. 8, the lighting unit 100 also may include a processor 102 that is configured to output one or more control signals to drive the light sources 104A, 104B, and 104C so as to generate various intensities of light from the light sources. For example, in one implementation, the processor 102 may be configured to output at least one control signal for each light source so as to independently control the intensity of light (e.g., radiant power in lumens) generated by each light source. Some examples of control signals that may be generated by the processor to control the light sources include, but are not limited to, pulse modulated signals, pulse width modulated signals (PWM), pulse amplitude modulated signals (PAM), pulse code modulated signals (PCM) analog control signals (e.g., current control signals, voltage control signals), combinations and/or modulations of the foregoing signals, or other control signals. In one aspect, one or more modulation techniques provide for variable control using a fixed current level applied to one or more LEDs, so as to mitigate potential undesirable or unpredictable variations in LED output that may arise if a variable LED drive current were employed. In another aspect, the processor 102 may control other dedicated circuitry (not shown in FIG. 8) which in turn controls the light sources so as to vary their respective intensities.

In one embodiment of the lighting unit 100, one or more of the light sources 104A, 104B, and 104C shown in FIG. 8 may include a group of multiple LEDs or other types of light sources (e.g., various parallel and/or serial connections of LEDs or other types of light sources) that are controlled together by the processor 102. Additionally, it should be appreciated that one or more of the light sources 104A, 104B, and 104C may include one or more LEDs that are adapted to generate radiation having any of a variety of spectra (i.e., wavelengths or wavelength bands), including, but not limited to, various visible colors (including essentially white light), various color temperatures of white light, ultraviolet, or infrared. LEDs having a variety of spectral bandwidths (e.g., narrow band, broader band) may be employed in various implementations of the lighting unit 100.

In another aspect of the lighting unit 100 shown in FIG. 8, the lighting unit 100 may be constructed and arranged to produce a wide range of variable color radiation. For example, the lighting unit 100 may be particularly arranged such that the processor-controlled variable intensity (i.e., variable radiant power) light generated by two or more of the light sources combines to produce a mixed colored light (including essentially white light having a variety of color temperatures). In particular, the color (or color temperature) of the mixed colored light may be varied by varying one or more of the respective intensities (output radiant power) of the light sources (e.g., in response to one or more control signals output by the processor 102). Furthermore, the processor 102 may be particularly configured (e.g., programmed) to provide control signals to one or more of the light sources so as to generate a variety of static or time-varying (dynamic) multi-color (or multi-color temperature) lighting effects.

Thus, the lighting unit 100 may include a wide variety of colors of LEDs in various combinations, including two or more of red, green, and blue LEDs to produce a color mix, as well as one or more other LEDs to create varying colors and color temperatures of white light. For example, red, green and blue can be mixed with amber, white, UV, orange, IR or other colors of LEDs. Such combinations of differently colored LEDs in the lighting unit 100 can facilitate accurate reproduction of a host of desirable spectrums of lighting conditions, examples of which include, but are not limited to, a variety of outside daylight equivalents at different times of the day, various interior lighting conditions, lighting conditions to simulate a complex multicolored background, and the like. Other desirable lighting conditions can be created by removing particular pieces of spectrum that may be specifically absorbed, attenuated or reflected in certain environments. Water, for example tends to absorb and attenuate most non-blue and non-green colors of light, so underwater applications may benefit from lighting conditions that are tailored to emphasize or attenuate some spectral elements relative to others.

As shown in FIG. 8, the lighting unit 100 also may include a memory 114 to store various information. For example, the memory 114 may be employed to store one or more lighting programs for execution by the processor 102 (e.g., to generate one or more control signals for the light sources), as well as various types of data useful for generating variable color radiation (e.g., calibration information, discussed further below). The memory 114 also may store one or more particular identifiers (e.g., a serial number, an address, etc.) that may be used either locally or on a system level to identify the lighting unit 100. In various embodiments, such identifiers may be pre-programmed by a manufacturer, for example, and may be either alterable or non-alterable thereafter (e.g., via some type of user interface located on the lighting unit, via one or more data or control signals received by the lighting unit, etc.). Alternatively, such identifiers may be determined at the time of initial use of the lighting unit in the field, and again may be alterable or non-alterable thereafter.

One issue that may arise in connection with controlling multiple light sources in the lighting unit 100 of FIG. 8, and controlling multiple lighting units 100 in a lighting system (e.g., as discussed below in connection with FIG. 9), relates to potentially perceptible differences in light output between substantially similar light sources. For example, given two virtually identical light sources being driven by respective identical control signals, the actual intensity of light (e.g., radiant power in lumens) output by each light source may be measurably different. Such a difference in light output may be attributed to various factors including, for example, slight manufacturing differences between the light sources, normal wear and tear over time of the light sources that may differently alter the respective spectrums of the generated radiation, etc. For purposes of the present discussion, light sources for which a particular relationship between a control signal and resulting output radiant power are not known are referred to as "uncalibrated" light sources.

The use of one or more uncalibrated light sources in the lighting unit 100 shown in FIG. 8 may result in generation of light having an unpredictable, or "uncalibrated," color or color temperature. For example, consider a first lighting unit including a first uncalibrated red light source and a first uncalibrated blue light source, each controlled by a corresponding control signal having an adjustable parameter in a range of from zero to 255 (0-255), wherein the maximum value of 255 represents the maximum radiant power available from the light source. For purposes of this example, if the red control signal is set to zero and the blue control signal is non-zero, blue light is generated, whereas if the blue control signal is set to zero and the red control signal is non-zero, red light is generated. However, if both control signals are varied from non-zero values, a variety of perceptibly different colors may be produced (e.g., in this example, at very least, many different shades of purple are possible). In particular, perhaps a particular desired color (e.g., lavender) is given by a red control signal having a value of 125 and a blue control signal having a value of 200.

Now consider a second lighting unit including a second uncalibrated red light source substantially similar to the first uncalibrated red light source of the first lighting unit, and a second uncalibrated blue light source substantially similar to the first uncalibrated blue light source of the first lighting unit. As discussed above, even if both of the uncalibrated red light sources are driven by respective identical control signals, the actual intensity of light (e.g., radiant power in lumens) output by each red light source may be measurably different. Similarly, even if both of the uncalibrated blue light sources are driven by respective identical control signals, the actual light output by each blue light source may be measurably different.

With the foregoing in mind, it should be appreciated that if multiple uncalibrated light sources are used in combination in lighting units to produce a mixed colored light as discussed above, the observed color (or color temperature) of light produced by different lighting units under identical control conditions may be perceivably different. Specifically, consider again the "lavender" example above; the "first lavender" produced by the first lighting unit with a red control signal having a value of 125 and a blue control signal having a value of 200 indeed may be perceivably different than a "second lavender" produced by the second lighting unit with a red control signal having a value of 125 and a blue control signal having a value of 200. More generally, the first and second lighting units generate uncalibrated colors by virtue of their uncalibrated light sources.

In view of the foregoing, in one embodiment of the present disclosure, the lighting unit 100 includes calibration means to facilitate the generation of light having a calibrated (e.g., predictable, reproducible) color at any given time. In one aspect, the calibration means is configured to adjust (e.g., scale) the light output of at least some light sources of the lighting unit so as to compensate for perceptible differences between similar light sources used in different lighting units.

For example, in one embodiment, the processor 102 of the lighting unit 100 is configured to control one or more of the light sources 104A, 104B, and 104C so as to output radiation at a calibrated intensity that substantially corresponds in a predetermined manner to a control signal for the light source (s). As a result of mixing radiation having different spectra and respective calibrated intensities, a calibrated color is produced. In one aspect of this embodiment, at least one calibration value for each light source is stored in the memory 114, and the processor is programmed to apply the respective calibration values to the control signals for the corresponding light sources so as to generate the calibrated intensities.

In one aspect of this embodiment, one or more calibration values may be determined once (e.g., during a lighting unit manufacturing/testing phase) and stored in the memory 114 for use by the processor 102. In another aspect, the processor 102 may be configured to derive one or more calibration values dynamically (e.g. from time to time) with the aid of one or more photosensors, for example. In various embodiments, the photosensor(s) may be one or more external components coupled to the lighting unit, or alternatively may be integrated as part of the lighting unit itself. A photosensor is one example of a signal source that may be integrated or otherwise associated with the lighting unit 100, and monitored by the processor 102 in connection with the operation of the lighting unit. Other examples of such signal sources are discussed further below, in connection with the signal source 124 shown in FIG. 8.

One exemplary method that may be implemented by the processor 102 to derive one or more calibration values includes applying a reference control signal to a light source (e.g., corresponding to maximum output radiant power), and measuring (e.g., via one or more photosensors) an intensity of radiation (e.g., radiant power falling on the photosensor) thus generated by the light source. The processor may be programmed to then make a comparison of the measured intensity and at least one reference value (e.g., representing an intensity that nominally would be expected in response to the reference control signal). Based on such a comparison, the processor may determine one or more calibration values (e.g., scaling factors) for the light source. In particular, the processor may derive a calibration value such that, when applied to the reference control signal, the light source outputs radiation having an intensity that corresponds to the reference value (i.e., an "expected" intensity, e.g., expected radiant power in lumens).

In various aspects, one calibration value may be derived for an entire range of control signal/output intensities for a given light source. Alternatively, multiple calibration values may be derived for a given light source (i.e., a number of calibration value "samples" may be obtained) that are respectively applied over different control signal/output intensity ranges, to approximate a nonlinear calibration function in a piecewise linear manner.

In another aspect, as also shown in FIG. 8, the lighting unit 100 optionally may include one or more user interfaces 118 that are provided to facilitate any of a number of user-selectable settings or functions (e.g., generally controlling the light output of the lighting unit 100, changing and/or selecting various pre-programmed lighting effects to be generated by the lighting unit, changing and/or selecting various parameters of selected lighting effects, setting particular identifiers such as addresses or serial numbers for the lighting unit, etc.). In various embodiments, the communication between the user interface 118 and the lighting unit may be accomplished through wire or cable, or wireless transmission.

In one implementation, the processor 102 of the lighting unit monitors the user interface 118 and controls one or more of the light sources 104A, 104B, and 104C based at least in part on a user's operation of the interface. For example, the processor 102 may be configured to respond to operation of the user interface by originating one or more control signals for controlling one or more of the light sources. Alternatively, the processor 102 may be configured to respond by selecting one or more pre-programmed control signals stored in memory, modifying control signals generated by executing a lighting program, selecting and executing a new lighting program from memory, or otherwise affecting the radiation generated by one or more of the light sources.

In particular, in one implementation, the user interface 118 may constitute one or more switches (e.g., a standard wall switch) that interrupt power to the processor 102. In one aspect of this implementation, the processor 102 is configured to monitor the power as controlled by the user interface, and in turn control one or more of the light sources 104A, 104B, and 104C based at least in part on a duration of a power interruption caused by operation of the user interface. As discussed above, the processor may be particularly configured to respond to a predetermined duration of a power interruption by, for example, selecting one or more pre-programmed control signals stored in memory, modifying control signals generated by executing a lighting program, selecting and executing a new lighting program from memory, or otherwise affecting the radiation generated by one or more of the light sources.

FIG. 8 also illustrates that the lighting unit 100 may be configured to receive one or more signals 122 from one or more other signal sources 124. In one implementation, the processor 102 of the lighting unit may use the signal(s) 122, either alone or in combination with other control signals (e.g., signals generated by executing a lighting program, one or more outputs from a user interface, etc.), so as to control one or more of the light sources 104A, 104B and 104C in a manner similar to that discussed above in connection with the user interface.

Examples of the signal(s) 122 that may be received and processed by the processor 102 include, but are not limited to, one or more audio signals, video signals, power signals, various types of data signals, signals representing information obtained from a network (e.g., the Internet), signals representing one or more detectable/sensed conditions, signals from lighting units, signals consisting of modulated light, etc. In various implementations, the signal source(s) 124 may be located remotely from the lighting unit 100, or included as a component of the lighting unit. For example, in one embodiment, a signal from one lighting unit 100 could be sent over a network to another lighting unit 100.

Some examples of a signal source 124 that may be employed in, or used in connection with, the lighting unit 100 of FIG. 8 include any of a variety of sensors or transducers that generate one or more signals 122 in response to some stimulus. Examples of such sensors include, but are not limited to, various types of environmental condition sensors, such as thermally sensitive (e.g., temperature, infrared) sensors, humidity sensors, motion sensors, photosensors/light sensors (e.g., photodiodes, sensors that are sensitive to one or more particular spectra of electromagnetic radiation such as spectroradiometers or spectrophotometers, etc.), various types of cameras, sound or vibration sensors or other pressure/force transducers (e.g., microphones, piezoelectric devices), and the like.

Additional examples of a signal source 124 include various metering/detection devices that monitor electrical signals or characteristics (e.g., voltage, current, power, resistance, capacitance, inductance, etc.) or chemical/biological characteristics (e.g., acidity, a presence of one or more particular chemical or biological agents, bacteria, etc.) and provide one or more signals 122 based on measured values of the signals or characteristics. Yet other examples of a signal source 124 include various types of scanners, image recognition systems, voice or other sound recognition systems, artificial intelligence and robotics systems, and the like. A signal source 124 could also be a lighting unit 100, a processor 102, or any one of many available signal generating devices, such as media players, MP3 players, computers, DVD players, CD players, television signal sources, camera signal sources, microphones, speakers, telephones, cellular phones, instant messenger devices, SMS devices, wireless devices, personal organizer devices, and many others.

In one embodiment, the lighting unit 100 shown in FIG. 8 also may include one or more optical elements 130 to optically process the radiation generated by the light sources 104A, 104B, and 104C. For example, one or more optical elements may be configured so as to change one or both of a spatial distribution and a propagation direction of the generated radiation. In particular, one or more optical elements may be configured to change a diffusion angle of the generated radiation. In one aspect of this embodiment, one or more optical elements 130 may be particularly configured to variably change one or both of a spatial distribution and a propagation direction of the generated radiation (e.g., in response to some electrical and/or mechanical stimulus). Examples of optical elements that may be included in the lighting unit 100 include, but are not limited to, reflective materials, refractive materials, translucent materials, filters, lenses, mirrors, and fiber optics. The optical element 130 also may include a phosphorescent material, luminescent material, or other material capable of responding to or interacting with the generated radiation.

As also shown in FIG. 8, the lighting unit 100 may include one or more communication ports 120 to facilitate coupling of the lighting unit 100 to any of a variety of other devices. For example, one or more communication ports 120 may facilitate coupling multiple lighting units together as a networked lighting system, in which at least some of the lighting units are addressable (e.g., have particular identifiers or addresses) and are responsive to particular data transported across the network.

In particular, in a networked lighting system environment, as discussed in greater detail further below (e.g., in connection with FIG. 9), as data is communicated via the network, the processor 102 of each lighting unit coupled to the network may be configured to be responsive to particular data (e.g., lighting control commands) that pertain to it (e.g., in some cases, as dictated by the respective identifiers of the networked lighting units). Once a given processor identifies particular data intended for it, it may read the data and, for example, change the lighting conditions produced by its light sources according to the received data (e.g., by generating appropriate control signals to the light sources). In one aspect, the memory 114 of each lighting unit coupled to the network may be loaded, for example, with a table of lighting control signals that correspond with data the processor 102 receives. Once the processor 102 receives data from the network, the processor may consult the table to select the control signals that correspond to the received data, and control the light sources of the lighting unit accordingly.

In one aspect of this embodiment, the processor 102 of a given lighting unit, whether or not coupled to a network, may be configured to interpret lighting instructions/data that are received in a DMX protocol (as discussed, for example, in U.S. Pat. Nos. 6,016,038 and 6,211,626), which is a lighting command protocol conventionally employed in the lighting industry for some programmable lighting applications. For example, in one aspect, a lighting command in DMX protocol may specify each of a red channel control signal, a green channel control signal, and a blue channel control signal as an eight-bit digital signal representing a number from 0 to 255, wherein the maximum value of 255 for any one of the color channels instructs the processor 102 to control the corresponding light source(s) to generate the maximum available radiant power for that color (such a command structure is commonly referred to as 24-bit color control). Hence, a command of the format [R, G, B] =[255, 255, 255] would cause the lighting unit to generate maximum radiant power for each of red, green and blue light (thereby creating white light). It should be appreciated, however, that lighting units suitable for purposes of the present disclosure are not limited to a DMX command format, as lighting units according to various embodiments may be configured to be responsive to other types of communication protocols so as to control their respective light sources.

In one embodiment, the lighting unit 100 of FIG. 8 may include and/or be coupled to one or more power sources 108. In various aspects, examples of power source(s) 108 include, but are not limited to, AC power sources, DC power sources, batteries, solar-based power sources, thermoelectric or mechanical-based power sources and the like. Additionally, in one aspect, the power source(s) 108 may include or be associated with one or more power conversion devices that convert power received by an external power source to a form suitable for operation of the lighting unit 100.

While not shown explicitly in FIG. 8, the lighting unit 100 may be implemented in any one of several different structural configurations according to various embodiments of the present disclosure. Examples of such configurations include, but are not limited to, an essentially linear or curvilinear configuration, a circular configuration, an oval configuration, a rectangular configuration, combinations of the foregoing, various other geometrically shaped configurations, various two or three dimensional configurations, and the like.

A given lighting unit also may have any one of a variety of mounting arrangements for the light source(s), enclosure/housing arrangements and shapes to partially or fully enclose the light sources, and/or electrical and mechanical connection configurations. In particular, a lighting unit may be configured as a replacement or "retrofit" to engage electrically and mechanically in a conventional socket or fixture arrangement (e.g., an Edison-type screw socket, a halogen fixture arrangement; a fluorescent fixture arrangement, etc.).

Additionally, one or more optical elements as discussed above may be partially or fully integrated with an enclosure/housing arrangement for the lighting unit. Furthermore, a given lighting unit optionally may be associated with (e.g., include, be coupled to and/or packaged together with) various other components (e.g., control circuitry such as the processor and/or memory, one or more sensors/transducers/signal sources, user interfaces, displays, power sources, power conversion devices, etc.) relating to the operation of the light source(s).

Figure 9:
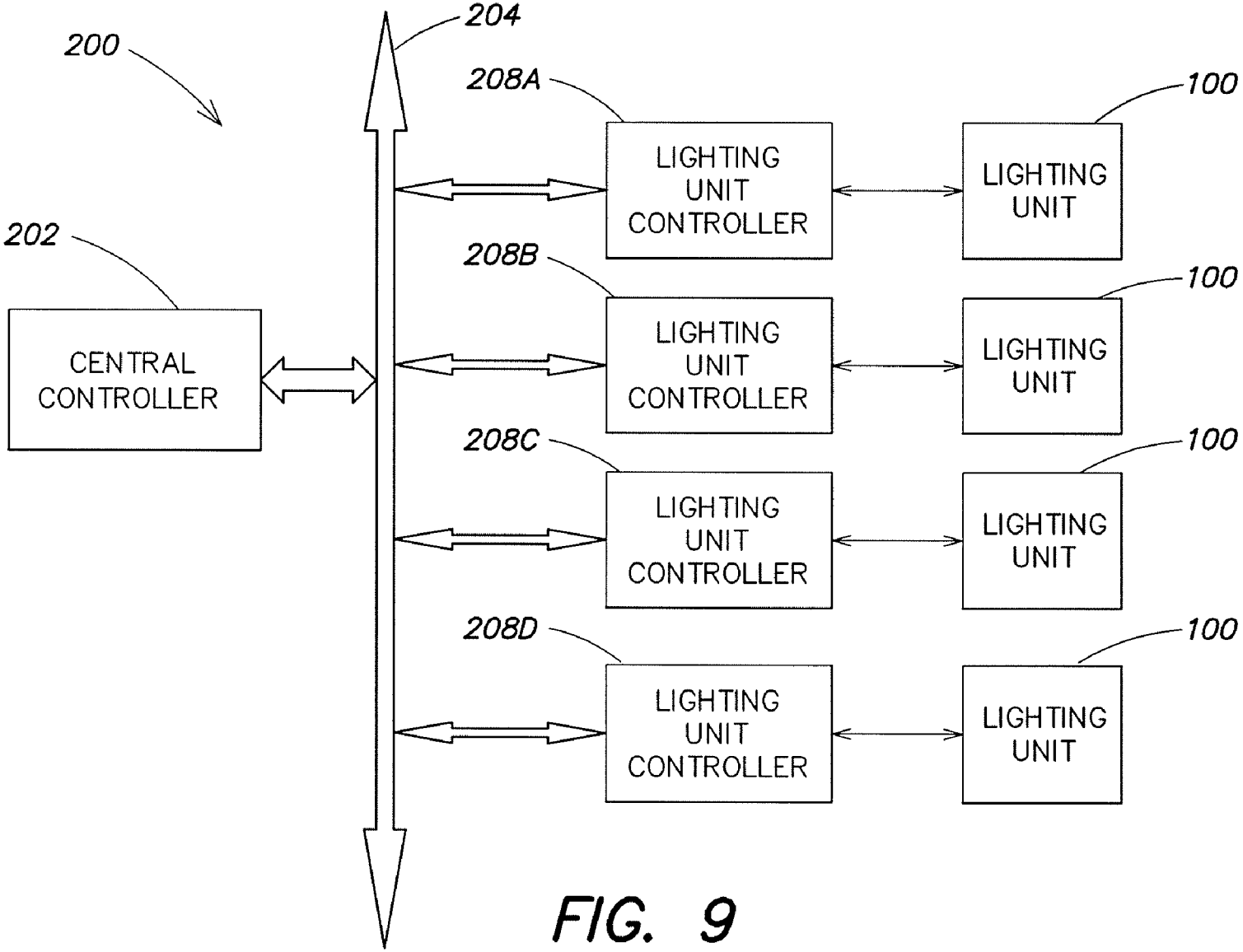
FIG. 9 is a diagram illustrating a networked lighting system according to one embodiment of the disclosure.

FIG. 9 illustrates an example of a networked lighting system 200 according to one embodiment of the present disclosure. In the embodiment of FIG. 9, a number of lighting units 100, similar to those discussed above in connection with FIG. 8, are coupled together to form the networked lighting system. It should be appreciated, however, that the particular configuration and arrangement of lighting units shown in FIG. 9 is for purposes of illustration only, and that the disclosure is not limited to the particular system topology shown in FIG. 9.

Additionally, while not shown explicitly in FIG. 9, it should be appreciated that the networked lighting system 200 may be configured flexibly to include one or more user interfaces, as well as one or more signal sources such as sensors/transducers. For example, one or more user interfaces and/or one or more signal sources such as sensors/transducers (as discussed above in connection with FIG. 8) may be associated with any one or more of the lighting units of the networked lighting system 200. Alternatively (or in addition to the foregoing), one or more user interfaces and/or one or more signal sources may be implemented as "stand alone" components in the networked lighting system 200. Whether stand alone components or particularly associated with one or more lighting units 100, these devices may be "shared" by the lighting units of the networked lighting system. Stated differently, one or more user interfaces and/or one or more signal sources such as sensors/transducers may constitute "shared resources" in the networked lighting system that may be used in connection with controlling any one or more of the lighting units of the system.

As shown in the embodiment of FIG. 9, the lighting system 200 may include one or more lighting unit controllers (hereinafter "LUCs") 208A, 208B, 208C, and 208D, wherein each LUC is responsible for communicating with and generally controlling one or more lighting units 100 coupled to it. Although FIG. 9 illustrates one lighting unit 100 coupled to each LUC, it should be appreciated that the disclosure is not limited in this respect, as different numbers of lighting units 100 may be coupled to a given LUC in a variety of different configurations (serially connections, parallel connections, combinations of serial and parallel connections, etc.) using a variety of different communication media and protocols.

In the system of FIG. 9, each LUC in turn may be coupled to a central controller 202 that is configured to communicate with one or more LUCs. Although FIG. 9 shows four LUCs coupled to the central controller 202 via a generic connection 204 (which may include any number of a variety of conventional coupling, switching and/or networking devices), it should be appreciated that according to various embodiments, different numbers of LUCs may be coupled to the central controller 202. Additionally, according to various embodiments of the present disclosure, the LUCs and the central controller may be coupled together in a variety of configurations using a variety of different communication media and protocols to form the networked lighting system 200. Moreover, it should be appreciated that the interconnection of LUCs and the central controller, and the interconnection of lighting units to respective LUCs, may be accomplished in different manners (e.g., using different configurations, communication media, and protocols).

For example, according to one embodiment of the present disclosure, the central controller 202 shown in FIG. 9 may by configured to implement Ethernet-based communications with the LUCs, and in turn the LUCs may be configured to implement DMX-based communications with the lighting units 100. In particular, in one aspect of this embodiment, each LUC may be configured as an addressable Ethernet-based controller and accordingly may be identifiable to the central controller 202 via a particular unique address (or a unique group of addresses) using an Ethernet-based protocol. In this manner, the central controller 202 may be configured to support Ethernet communications throughout the network of coupled LUCs, and each LUC may respond to those communications intended for it. In turn, each LUC may communicate lighting control information to one or more lighting units coupled to it, for example, via a DMX protocol, based on the Ethernet communications with the central controller 202.

More specifically, according to one embodiment, the LUCs 208A, 208B, and 208C shown in FIG. 9 may be configured to be "intelligent" in that the central controller 202 may be configured to communicate higher level commands to the LUCs that need to be interpreted by the LUCs before lighting control information can be forwarded to the lighting units 100. For example, a lighting system operator may want to generate a color changing effect that varies colors from lighting unit to lighting unit in such a way as to generate the appearance of a propagating rainbow of colors ("rainbow chase"), given a particular placement of lighting units with respect to one another. In this example, the operator may provide a simple instruction to the central controller 202 to accomplish this, and in turn the central controller may communicate to one or more LUCs using an Ethernet-based protocol high level command to generate a "rainbow chase." The command may contain timing, intensity, hue, saturation or other relevant information, for example. When a given LUC receives such a command, it may then interpret the command and communicate further commands to one or more lighting units using a DMX protocol, in response to which the respective sources of the lighting units are controlled via any of a variety of signaling techniques (e.g., PWM).

It should again be appreciated that the foregoing example of using multiple different communication implementations (e.g., Ethernet/DMX) in a lighting system according to one embodiment of the present disclosure is for purposes of illustration only, and that the disclosure is not limited to this particular example.

From the foregoing, it may be appreciated that one or more lighting units as discussed above are capable of generating highly controllable variable color light over a wide range of colors, as well as variable color temperature white light over a wide range of color temperatures. To configure any such lighting unit for use in a color-managed system or process, a target color management profile needs to be established that specifies the color generating capabilities of the lighting unit in terms of a common working color space. In one exemplary implementation, a target color management profile may be formatted as an ICC profile for use in a color-managed system or process based on the ICC standards. It should be appreciated, however, that the present disclosure is not limited in this respect, as a target color management profile according to any of a variety of file specifications and color management standards may be established for a given lighting unit according to the concepts discussed herein.

To establish a target color management profile for a given lighting unit, first a spectral power distribution (SPD) may be measured or estimated for each of the different source spectrums of the lighting unit. For purposes of the discussion immediately below, an exemplary lighting unit 100 is considered having one or more red LEDs, one or more green LEDs, and one or more blue LEDs. With the foregoing in mind, an SPD may be measured (by an appropriate measuring instrument) for a red LED (or a group of red LEDs energized together), a green LED (or a group of green LEDs energized together), and a blue LED (or a group of blue LEDs energized together); alternatively, an SPD may be assumed for a given color LED source or group of sources energized together, based on an expected/approximate dominant wavelength, FWHM, and radiant power. In one aspect of this embodiment, the SPDs are measured (or estimated) at maximum available radiant powers for the respective source spectrums.

For some applications, whether the SPDs are measured or estimated, it may be desirable to take into account one or more intervening surfaces between the generated light and an anticipated point of perception of the light. For example, consider an application in which a given lighting unit is positioned so as to illuminate one or more walls of a room, and the light generated by the lighting unit generally is perceived in the room after the light has reflected off of the wall(s). Based on the physical properties of the material constituting the wall(s), including possible wall coverings such as paints, wallpapers, etc., the light reflected from the wall(s) and ultimately perceived may have an appreciably different SPD than the light impinging on the wall(s). More specifically, the wall(s) (or any other intervening surface) may absorb/reflect each of the source spectrums (e.g., the red, green and blue light) somewhat differently. In view of the foregoing, in one embodiment some or all of the SPDs may be measured, estimated, or specifically modeled to include the effects of one or more intervening surfaces that may be present in a given application, so as to take into account light-surface interactions in the generation of light in a color-managed system or process.

The measured or estimated SPDs subsequently may be mapped to some color model or color space serving as a working color space for the color-managed process or system. As indicated above, in one exemplary implementation, the target color management profile may be formatted as an ICC profile that defines a device gamut for the lighting unit in terms of a CIE color system as a working color space, or profile connection space (PCS). As discussed above in connection with FIG. 1, the CIE color system provides one conventional example of a useful construct for categorizing color, via the CIE chromaticity diagram for example. While the discussion below focuses on the CIE color system (and, in particular, the CIE chromaticity diagram) as a working color space, again it should be appreciated that the concepts disclosed herein generally are applicable to any of a variety of constructs used to describe a color model, space, or system that may be employed as a working color space in a color-managed system or process.

In view of the foregoing, in one exemplary implementation, CIE chromaticity coordinates x,y may be calculated in the manner described above in connection with FIG. 1 and plotted on the CIE chromaticity diagram for each different source spectrum of the lighting unit 100. Depending on several factors including, but not limited to, dominant wavelength, spectral changes due to LED drive current and/or temperature, manufacturing differences and the like, and possible intervening surfaces, approximate but illustrative values for typical chromaticity-coordinates for the different LED colors are indicated in Table 1 below. As indicated earlier, exemplary approximate dominant wavelengths for commonly available red, green and blue LEDs include 615-635 nanometers for red LEDs, 515-535 nanometers for green LEDs, and 460-475 nanometers for blue LEDs.

TABLE 1

| LED Color | x-coordinate | y-coordinate |
|---|---|---|
| Red | 0.7 | 0.3 |
| Green | 0.17 | 0.68 |
| Blue | 0.115 | 0.14 |

Figure 4:
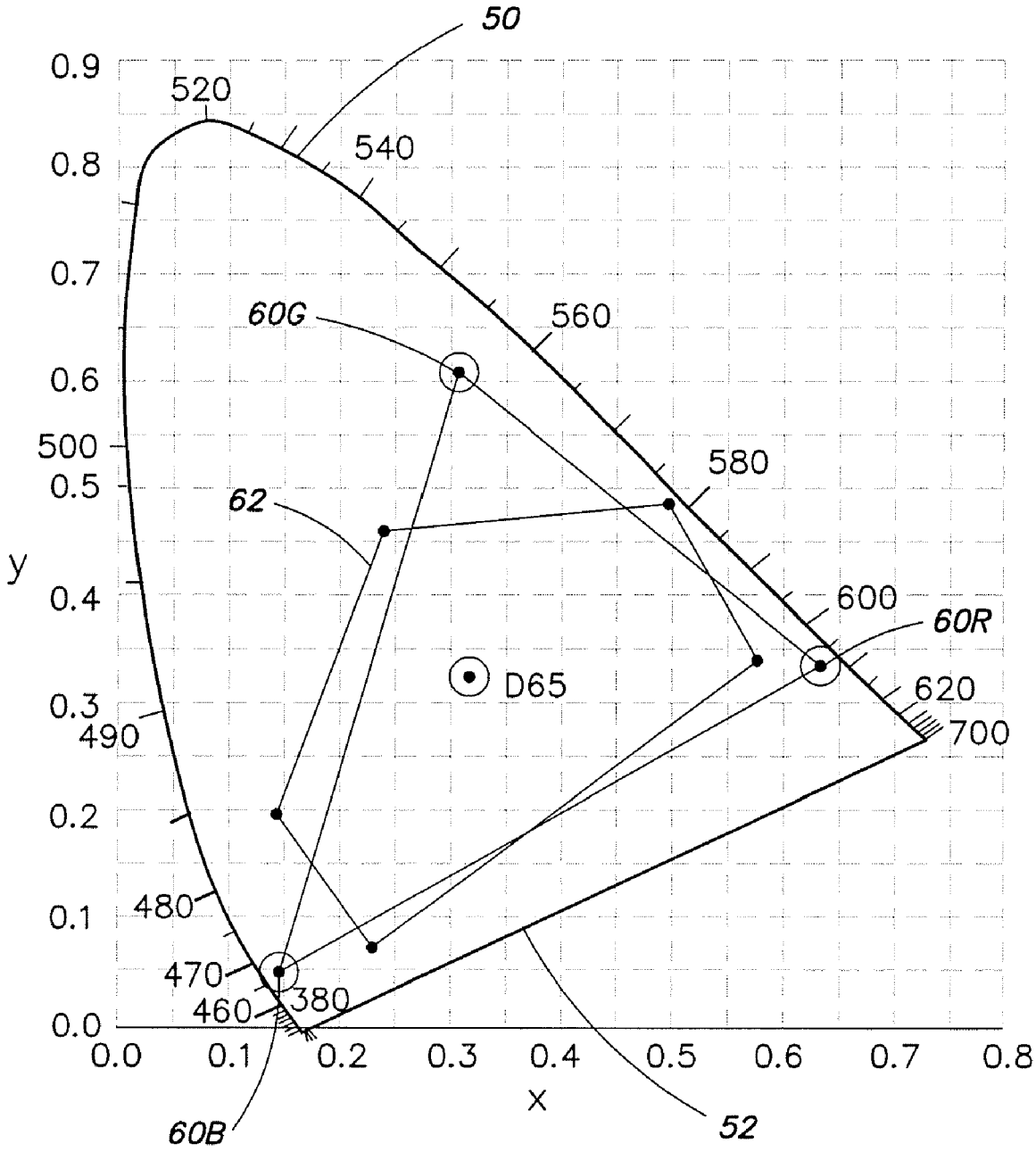
FIG. 4 PRIOR ART
FIG. 4 illustrates the diagram of FIG. 1, onto which are mapped exemplary gamuts for various color devices commonly found in a conventional computer environment.
Figure 5:
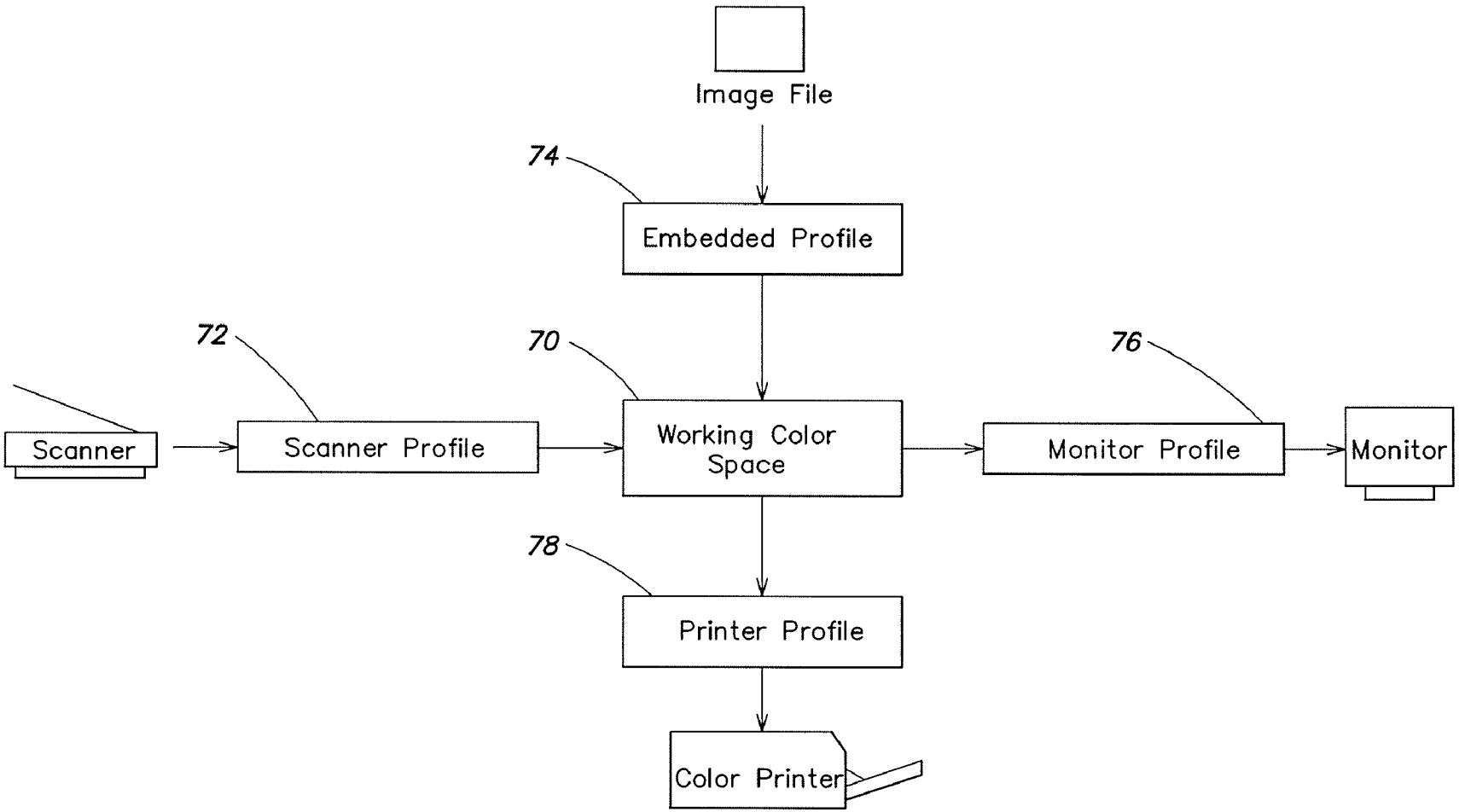
FIG. 5 illustrates the general concept of color management in terms of a "color-managed workflow" in a computer environment.
Figure 10:
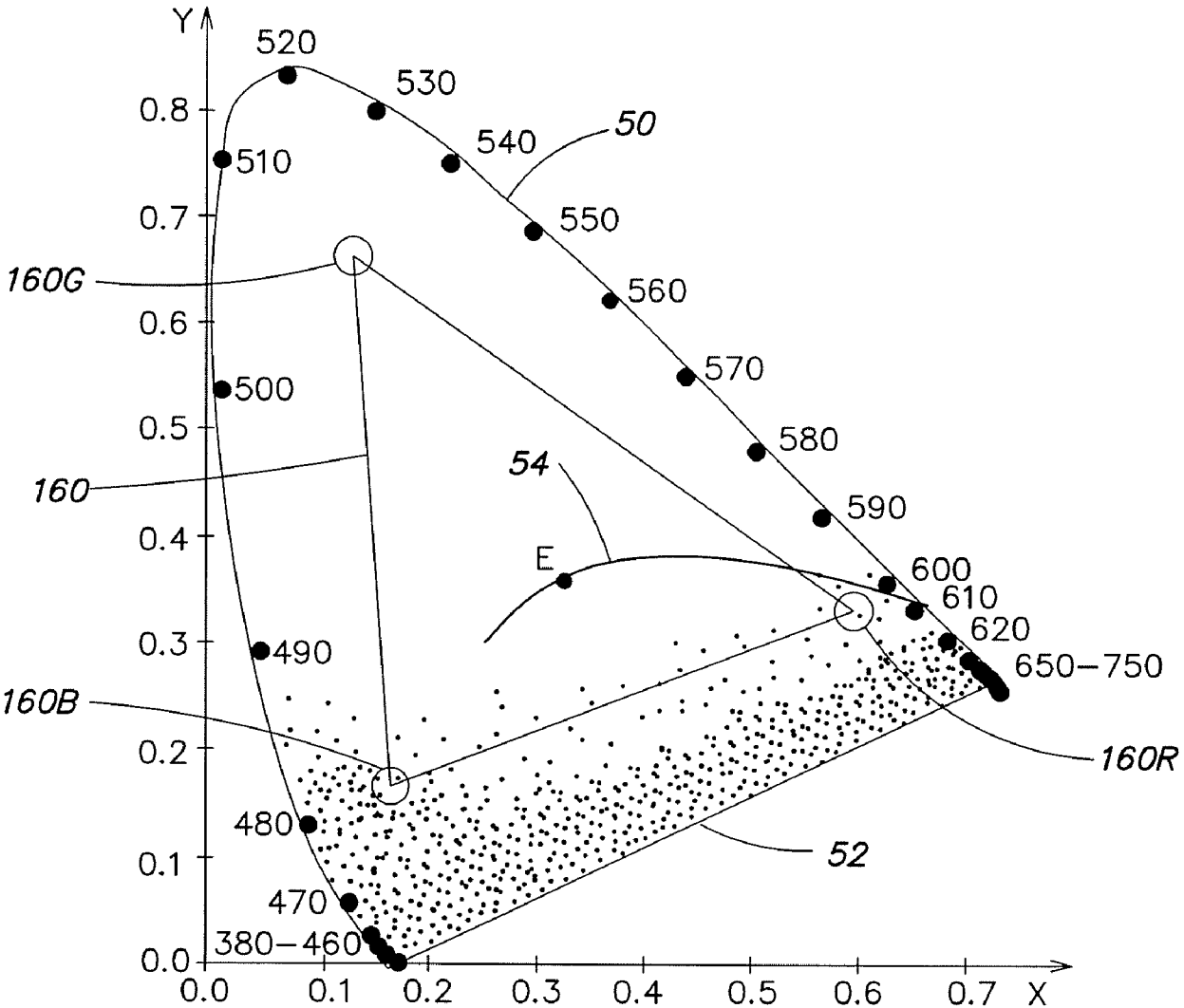
FIG. 10 illustrates the CIE diagram of FIG. 1, onto which is mapped an exemplary device gamut for a lighting unit according to one embodiment of the disclosure.

FIG. 10 illustrates the CIE diagram of FIG. 1, on which the above three chromaticity points from Table 1 are plotted as the points 160R, 160G and 160B, respectively. The resulting three points form a triangle similar to that of the gamut 60 shown in FIG. 4 (which represents the sRGB color space), although covering a somewhat larger area than the gamut 60. This triangle represents the device gamut 160 for the lighting unit in the working color space. As also illustrated in FIG. 10, the device gamut 160 for the lighting unit includes a significant portion of the white light/black body curve 54.

Once the device gamut 160 for the lighting unit is specified in the common working color space of the color-managed system or process (e.g., the CIE chromaticity diagram), a transformation may be determined to subsequently map colors indicated in the common working color space to lighting commands for the lighting unit, wherein each lighting command represents a particular combination of the red, green and blue source spectrums of the lighting unit 100 to reproduce or approximate a color specified in the working color space. The nature of such a transformation between a general device gamut and lighting commands was discussed above in connection with Eq. (2). For the target color management profile of a lighting unit according to the present disclosure, essentially an inverse of the transformation indicated in Eq. (2) is represented in the profile; i.e., in one embodiment, numerical data is provided in the profile to facilitate a mapping from CIE x,y coordinates and a Y parameter in the working color space (or CIE X, Y, Z tristimulus values), to an [R, G, B] command for the lighting unit.

It should be appreciated that the concepts discussed above may be implemented for each of multiple lighting units 100 of a lighting network similar to that shown in FIG. 9, to provide a color-managed system of multiple lighting units. In particular, a target color management profile (e.g., an ICC profile) for a given lighting unit may be stored in the memory 114 of the lighting unit, or in some other centralized location (e.g., the central controller 202 shown in FIG. 9), for access by a color-matching module, or "color engine" (discussed further below) to provide color-managed light generation from one or more lighting units.

While the foregoing discussion relied on the example of a device gamut for a lighting unit based on red, green and blue LED sources in the lighting unit 100, it should be appreciated that the disclosure is not limited in this respect, as lighting units according to other embodiments may have any number of different source spectrums, or "primaries," including, in addition to, or instead of, the red, green and blue primaries. In particular, according to other embodiments, a given lighting unit may include various combinations of red LEDs, green LEDs, blue LEDs, yellow LEDs, amber LEDs, orange LEDs, cyan LEDs or white LEDs of different color temperatures, for example, leading to any of a variety of possible device gamuts for which a corresponding target color management profile may be established.

Moreover, according to another embodiment, an arbitrary reference gamut may be specified for one lighting unit or a group of multiple lighting units, wherein the reference gamut is different (e.g., smaller) than the device gamut associated with one or more of the lighting units. In one aspect of this embodiment, a target color management profile may be established for a given lighting unit based on the reference gamut. For example, a target color management profile may be established for a given lighting unit that limits the color capability of the lighting unit to the sRGB color space (which in some instances may be significantly smaller than the actual device gamut for the lighting unit). If multiple such units are each associated with a target color management profile that likewise limits the color capability of the lighting unit to the sRGB space (or some other reference gamut shared by the lighting units), the group of lighting units may be controlled to predictably reproduce the same range of colors in a color-managed process or system.

In sum, via a target color management profile, any arbitrary lighting unit according to various embodiments of the present invention, having any of a variety of device gamuts or for which a predetermined reference gamut is specified, may be employed in a color-managed process or system according to the concepts discussed herein.

Figure 11:
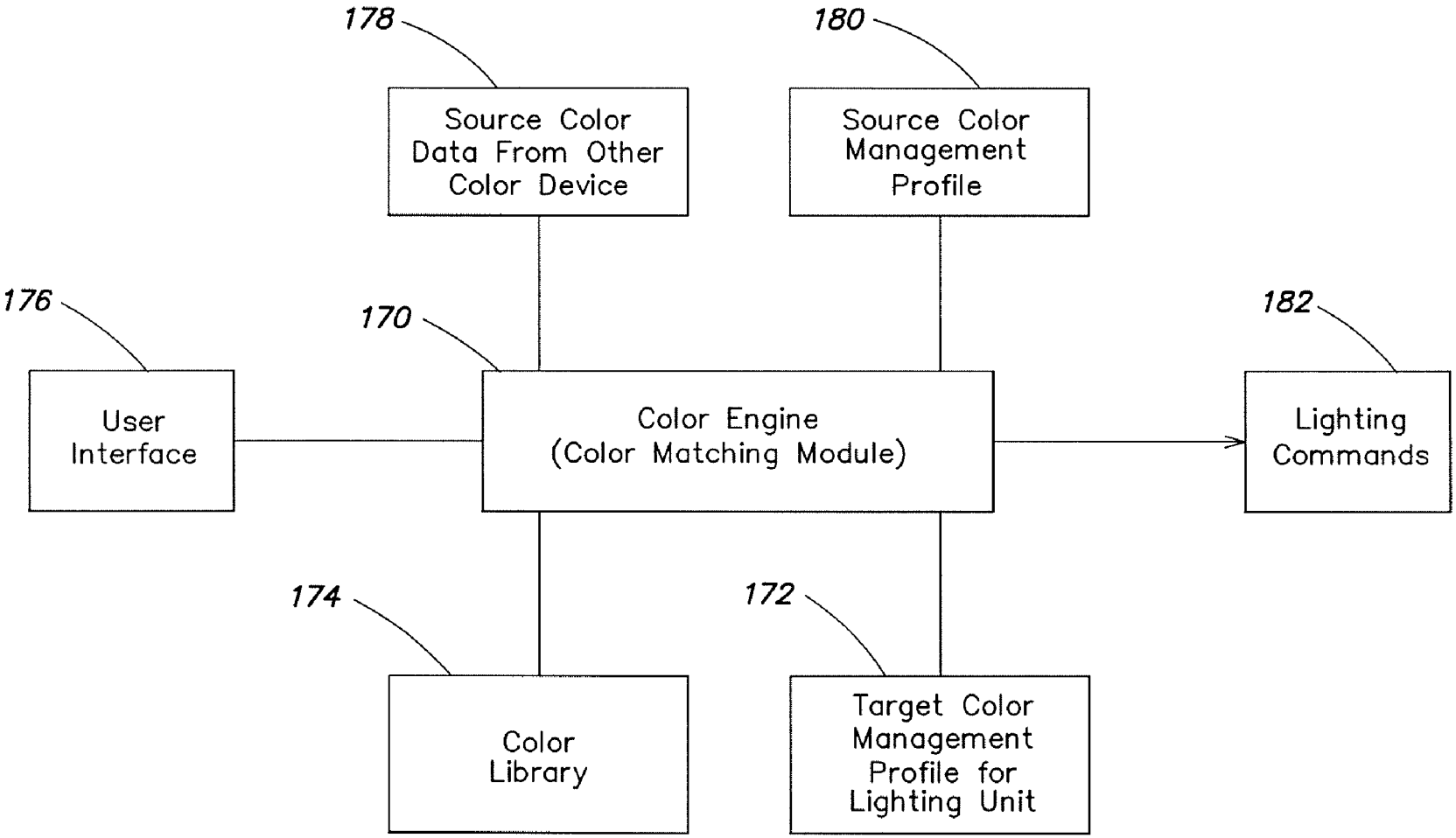
FIG. 11 illustrates various elements of a color-managed system or process for one or more lighting units according to one embodiment of the disclosure.

FIG. 11 illustrates various elements of a color-managed system or process for one or more lighting units according to one embodiment of the present disclosure. In one aspect of the embodiment shown in FIG. 11, a color-matching module or "color engine" 170 is configured to provide one or more lighting commands 182 to control one or more lighting units, based in part on a target color management profile 172 for each lighting unit to be controlled. In particular, as discussed above, the color engine 170 is configured to map one or more colors defined in the working color space to one or more lighting commands 182 for a given lighting unit, based on a device gamut (or other color space, such as a reference gamut) specified for the lighting unit by the target color management profile.

Figure 6:
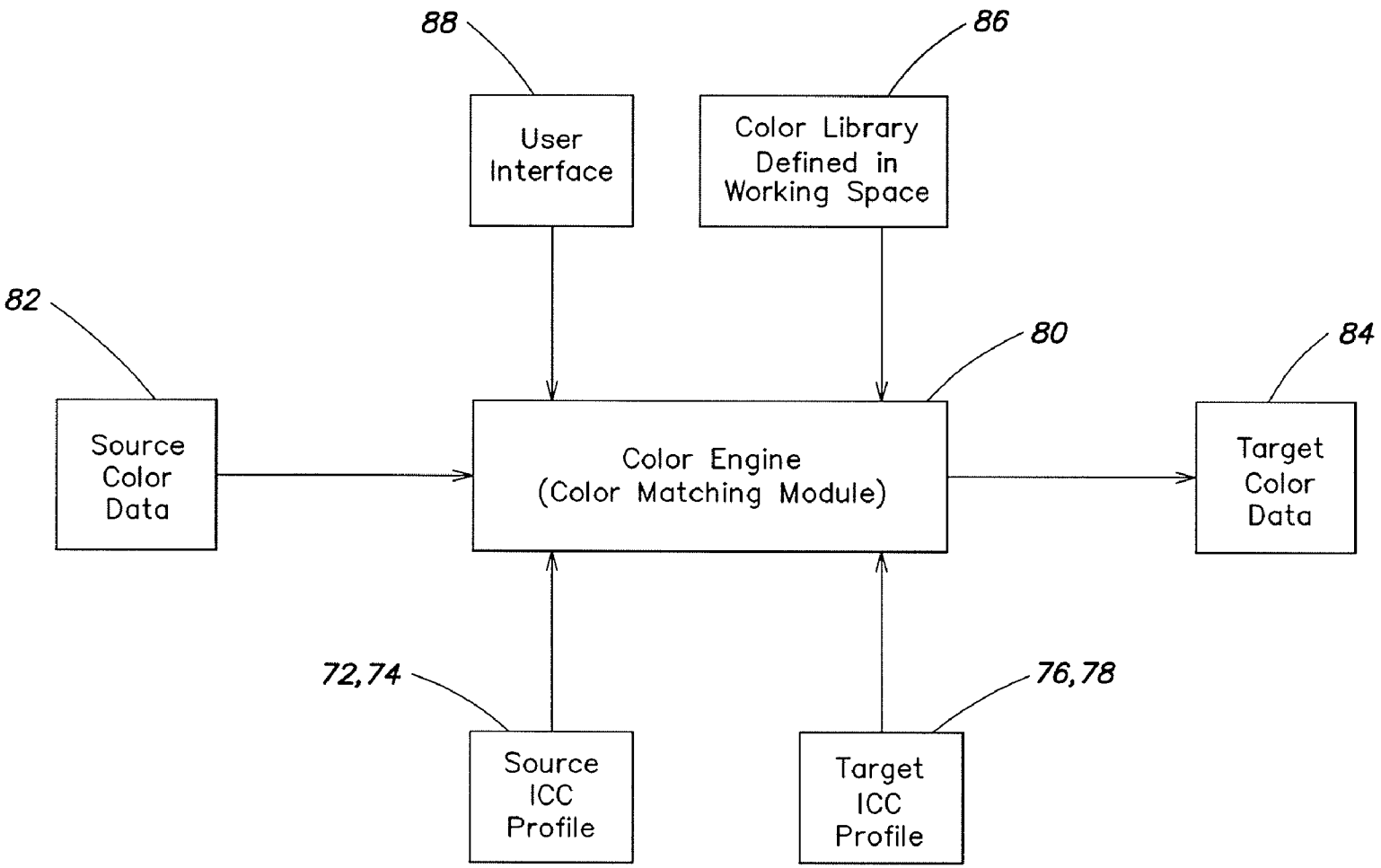
FIG. 6 illustrates a color management source-target gamut mapping process.
Figure 7:
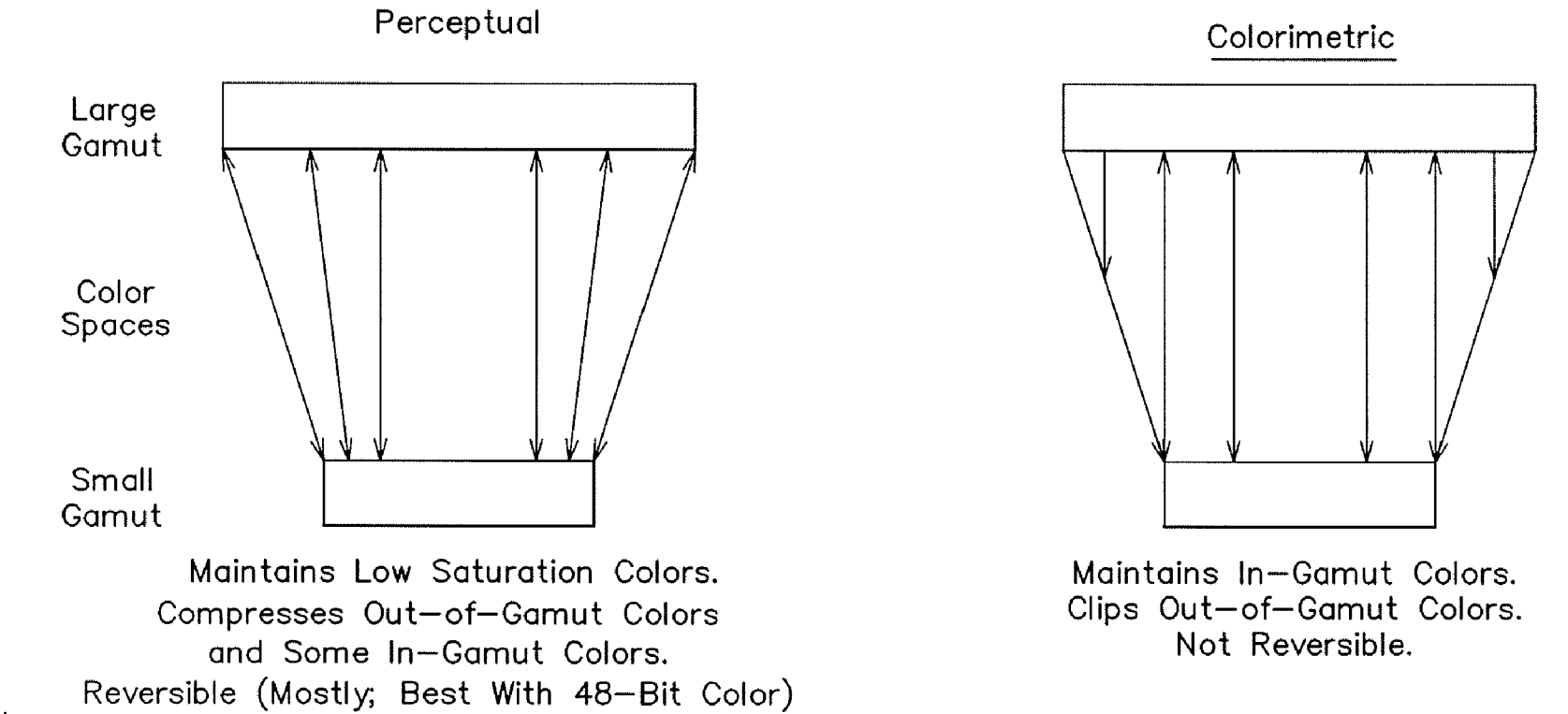
FIG. 7 illustrates various rendering intents that may be used in the source-target gamut mapping process shown in FIG. 6.

In FIG. 11, colors defined in the working color space may come from a variety of sources. For example, the color engine 170 may receive source color data 178 from another color device (e.g., a scanner, a digital camera, a color image file) and map the source color data 178 to the working color space based on a source color management profile 180. As discussed above in connection with FIG. 6 and other figures, in one exemplary implementation both the source color management profile 180 and the target color management profile 172 may be ICC profiles and the working color space, or profile connection space, may be a CIE color space.

As also shown in FIG. 11, a color for reproduction by one or more lighting units may be selected from a color library 174 via a user interface 176. For example, any of a wide variety of colors for reproduction may be included in the color library 174, specified in terms of the working color space and any other relevant color management standards (e.g., pertaining to viewing environment). In one aspect, colors may be arranged or catalogued in the library according to one or more palettes for selection via the user interface 176 (e.g., a GUI). The color library 174 may include one or more colors corresponding to commercially available vendor-specified colors from a variety of vendors including, but not limited to, Pantone (www.pantone.com), Munsell (www.munsell.com), Rosco (www.rosco.com), Lee (www.leefilters.com) or GAM (www.gamonline.com). Furthermore, the color library may include one or more custom colors defined by a user, in some cases based on combinations or alterations of industry-standard or vendor-specified colors.

According to various implementations, the color engine 170 may be configured to provide one or more lighting commands 182 for color reproduction based on one or more rendering intents. As discussed above, a rendering intent determines how the color engine handles a request to reproduce a color specified in the working color space if the color is not included in the gamut represented by the target color management profile 172 (i.e., the requested color is "out of gamut"). In various embodiments, the color engine may be configured to implement one of four rendering intents according to the ICC standard, namely perceptual rendering, absolute colorimetric rendering, relative calorimetric rendering, or saturation rendering. In general, colorimetric rendering intents enable in-gamut colors to be reproduced accurately at the expense of out of gamut colors.

It should be appreciated that, in different embodiments, the color engine 170 shown in FIG. 11 may be implemented in a variety of manners and in a variety of locations in a color-managed system or process according to the present disclosure. For example, with reference again to FIG. 8, in one embodiment the color engine 170 may be implemented as a program executed by the processor 102 of a given lighting unit. In one aspect of this embodiment, the color engine program may be stored in the memory 114, and/or transferred to the lighting unit via one or more communication ports 120. In another aspect, the target color management profile 172 for the lighting unit also may be stored in the memory 114 for access by the color engine 170. In other aspects, the user interface 176 shown in FIG. 11 may correspond to the user interface 118 shown in FIG. 8, and the color library 174 also may be stored in the memory 114 of the lighting unit. Additionally, for color reproduction based on another color device, the source color data 176 and the source color management profile 180 corresponding to another color device may be communicated to the lighting unit and made available to the color engine via one or more communication ports 120.

In another embodiment, the color engine 170 shown in FIG. 11 may be implemented as a program executed by a different processor external to a given lighting unit, wherein lighting commands 182 provided by the color engine are communicated to the lighting unit via the one or more communication ports 120. In different aspects of this embodiment, the target color management profile 172 for the lighting unit may be stored in the memory 114 of the lighting unit and accessed by the color engine via the one or more communication ports 120 of the lighting unit, or alternatively stored in some other location that may be accessed by the color engine.

In one exemplary implementation based on the network architecture illustrated in FIG. 9, the central controller 202 or one or more lighting unit controllers 208 of a lighting system 200 may be configured to include one or more color engines 170, which in turn have access to one or more target color management profiles respectively associated with one or more lighting units 100 of the lighting system 200. In particular, in one implementation, the central controller 202 may be configured to implement a color engine as well as store multiple target color management profiles each corresponding to one of the lighting units 100. The central controller 202 also may be configured to store one or more source color management profiles and/or the color library 174. The user interface 176 shown in FIG. 11 may be configured to communicate with the central controller 202 of the system shown in FIG. 9 to facilitate color reproduction in one or more of the lighting units of the system based on data from one or more other color devices, and/or colors from the color library.

From the foregoing, it should be appreciated that a variety of configurations for implementing a color-managed process or system according to the concepts presented herein are contemplated by the present disclosure.

Figure 12A:
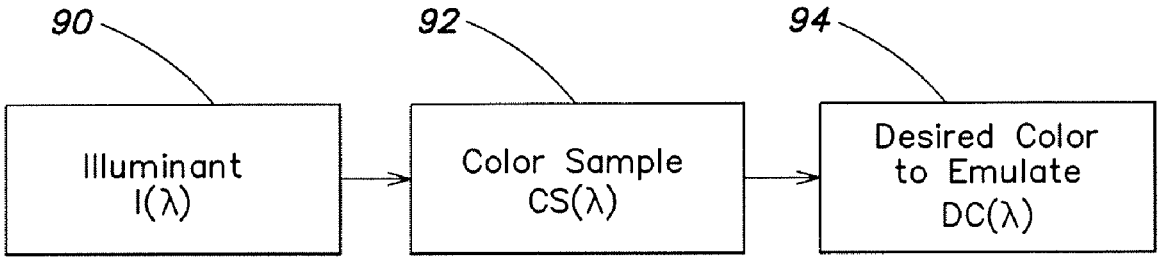
FIGS. 12A and 12B conceptually illustrate an exemplary application for one or more lighting units configured for use in a color-managed process or system, according to one embodiment of the disclosure, in which a color of an illuminated surface is emulated.
Figure 12B:
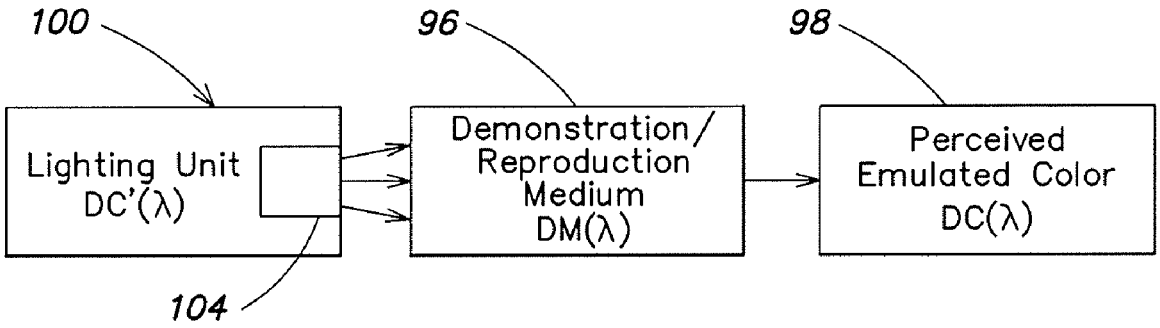

In addition, based on the general color management framework discussed above, a number of possible applications are contemplated for one or more lighting units configured for use in color-managed processes or systems according to the present disclosure. FIGS. 12A and 12B conceptually illustrate one such exemplary application, in which one or more lighting units are employed to emulate a color of an illuminated surface.

In FIG. 12A, a process is depicted whereby a source of illumination, or "illuminant" 90, illuminates a color sample 92, resulting in a perceivable color reflected from (or transmitted through) the color sample corresponding to a desired color to emulate 94. A spectral power distribution (SPD) of the desired color to emulate is indicated in FIG. 12A as DC(λ), which arises from the interaction of an SPD I(λ) of the illuminant and a color sample spectrum CS(λ) (representing the transmission/absorption characteristics of the color sample).

In various examples, the illuminant 90 may be any one of a number of conventional white light sources or natural sources of ambient light, for which the SPD I(λ) is measured or known a priori. In particular, the illuminant 90 may be one of a number of "standard illuminants" conventionally known in the relevant arts to represent commonly encountered illumination conditions having a prescribed SPD. For example, the illuminant 90 may correspond to any one of a Standard Illuminant A (filament lamp light, color temperature 2856 degrees K), Standard Illuminant C (medium daylight, without UV component, color temperature 6750 degrees K), Standard Illuminant D65 (medium daylight, with UV component, color temperature 6500 degrees K), Standard Illuminant F11 (fluorescent lamp), or others that may be defined (the joint ISO/CIE Standard specifies two illuminants for use in colorimetry, namely, Standard Illuminant A and Standard Illuminant D65).

The color sample 92 shown in FIG. 12 can take a variety of forms. In general, the color sample may be formed by any type of material from which light may be reflected, or through which light may be transmitted. For example, the color sample may be a "color spot" or "color swatch" of ink on some paper or related medium, representing any one of a wide variety of conventionally recognized (e.g., industry standard) vendor-specified colors (e.g., Pantone, see www.pantone.com; Munsell, see www.munsell.com). Other examples of color samples include, but are not limited to, paint samples or chips (which similarly may represent vendor-specified colors), other types of wall coverings, fabric samples, unpainted surfaces, and the like. Yet another example of a color sample includes any of a variety of color filters designed to transmit a predetermined spectrum of light based on one or more possible illuminants. Such filters are available from a variety of vendors and may be specified with particular absorption/transmission spectrums; some examples of filter vendors include, but are not limited to, Rosco Laboratories, Inc.(www.rosco.com), Lee Filters (www.leefilters.com), and GAM Products, Inc. (www.gamonline.com).

With reference again, for the moment to FIG. 11, in one embodiment the color library 174 may include one or more representations in the working color space corresponding to one or more illuminants 90. The color library also may include one or more representations in the working color space corresponding to one or more color samples 92, such that, via the user interface 178, a user may select an arbitrary combination of an illuminant and a color sample to arrive at a desired color to emulate 94. In another embodiment, representations in the working color space of predetermined combinations of illuminants and color samples may be stored in the color library for selection via the user interface. As discussed above, in yet another embodiment, the SPD I(λ) of an arbitrary illuminant (e.g., other than one of the standard illuminants) may be measured and a representation thereof in the working color space stored in the color library. Likewise, the spectrum DC(λ) of the desired color to emulate 94 may be measured directly, based on any arbitrary combination of illuminant and color sample, and a representation thereof in the working color space stored in the color library.

FIG. 12B illustrates an exemplary lighting unit 100 according to any of the concepts discussed herein, wherein the lighting unit illuminates some demonstration or reproduction medium 96 on which a resulting emulated color 98 is observed. As indicated by the spectrum DC(λ), the emulated color 98 preferably is a substantially accurate reproduction of the desired color 94. In some embodiments, the emulated color 98 may be a best approximation for the desired color 94; for example, in situations where the desired color 94 may be out of gamut with respect to the specified gamut for the lighting unit (as represented by the target color management profile), a color engine similar to that shown in FIG. 11 may implement a predetermined rendering intent to provide some reasonable approximation of the desired color.

As also shown in FIG. 12B, the demonstration/reproduction medium 96 may have some associated transmission/absorption spectrum DM(λ) that may be taken into consideration in the emulation of the desired color. For example, the demonstration/reproduction medium 96 may be a projector screen, one or more essentially white walls (or other architectural planes or features of various colors), or any of a variety of other transmissive or reflective materials from which the light generated by the lighting unit ultimately is perceived as the emulated color 98. Additionally, the lighting conditions under which the emulated color 98 is perceived from the demonstration/reproduction medium 96 optionally may be taken into consideration in the spectrum DM(λ). So as to ultimately provide a perceived emulated color 98 having a spectrum that matches that of the desired color 94, the required SPD DC'(λ) of the light actually generated by the lighting unit 100 may be determined as follows:

$$DC'(\lambda) = \frac{DC(\lambda)}{DM(\lambda)} = \frac{I(\lambda)CS(\lambda)}{DM(\lambda)}. \tag{3}$$

The relationship indicated in Eq. (3) above may be implemented in a color-managed process or system similar to that discussed above in connection with FIG. 11 in a number of ways. For example, in one implementation, a representation of DM(λ) in the working color space for one or more anticipated demonstration/reproduction media may be accessible to the color engine 170 (e.g., measured a priori and stored in the color library 174). Presuming that either a direct representation of DC(λ) in the working color space also is available to the color engine 170, or a representation in the working color space of the illuminant SPD I(λ) and the color sample SPD CS(λ) (e.g., stored in the color library 174 and selected via the user interface), the color engine may be configured to directly determine a representation in the working color space of DC'(λ) based on Eq. (3) above. From this representation, by virtue of the target color management profile for the lighting unit, the color engine may output lighting commands to the lighting unit so as to generate light having (or reasonably approximating) the SPD DC'(λ).

In another exemplary implementation, the spectrum DM(λ) may be taken into consideration in the determination of the target color management profile for the lighting unit, such that the combination of the lighting unit 100 and the demonstration/reproduction medium 96 essentially are profiled as one color device. Recall from the discussion above that, in determining a target color management profile for the lighting unit based on an SPD for each different source spectrum in the lighting unit, it may be desirable to take into account one or more intervening surfaces between the generated light and an anticipated point of perception of the light, in that the intervening surface(s) may absorb/reflect each of the source spectrums somewhat differently. Accordingly, in one embodiment, the source spectrum SPDs may be measured, estimated, or specifically modeled to include the effects of one or more intervening surfaces, such as the demonstration/reproduction medium 96 (e.g., the SPDs of the lighting unit source spectrums may each be measured upon reflection from, or transmission through, the medium 96). In this manner, the target color management profile constructed from these SPDs represents a "virtual" color device comprising the lighting unit and demonstration/reproduction medium in combination (i.e., in this example, there is no need for the color engine to separately consider the spectrum DM(λ) in determining appropriate lighting commands for the lighting unit).

It should be appreciated that the concepts discussed above in connection with FIGS. 12A and 12B may be implemented in a lighting system similar to that shown in FIG. 9, for example. In particular, in one embodiment, multiple lighting units may be arranged to illuminate a common demonstration/reproduction medium (e.g., a large screen or wall) or respective demonstration/reproduction media each associated with one or more lighting units, to emulate a desired color. In one exemplary application, one or more surfaces, in some cases constituting significant architectural spaces, may be illuminated so as to emulate or reasonably approximate a desired color selected from amongst a wide variety of vendor-specified or custom colors defined in the working color space of a color-managed system or process. In various aspects of this exemplary application, a single desired color at a given time may be emulated on an illuminated surface of virtually any size, multiple desired colors may be emulated simultaneously on different portions of an illuminated surface, or multiple desired colors may be emulated in sequence on an entire surface, or different portions of an illuminated surface, to create a variety of color-managed dynamic lighting effects.

Having thus described several illustrative embodiments, it is to be appreciated that various alterations, modifications, and improvements will readily occur to those skilled in the art. Such alterations, modifications, and improvements are intended to be part of this disclosure, and are intended to be within the spirit and scope of this disclosure. While some examples presented herein involve specific combinations of functions or structural elements, it should be understood that those functions and elements may be combined in other ways according to the present invention to accomplish the same or different objectives. In particular, acts, elements, and features discussed in connection with one embodiment are not intended to be excluded from similar or other roles in other embodiments. Accordingly, the foregoing description and attached drawings are by way of example only, and are not intended to be limiting.

The invention claimed is:

1. A color-managed illumination system, comprising:

at least one lighting unit comprising:

at least one first LED configured to generate first light having a first spectrum;

at least one second LED configured to generate second light having a second spectrum different from the first spectrum; and at least one controller configured to control the first light and the second light so as to generate from the at least one lighting unit a range of colors or color temperatures of perceived light;

at least one target color management profile associated with the at least one lighting unit, the at least one target color management profile representing a first mapping from a working color space for the color-managed illumination system to a lighting unit color gamut that specifies the range of colors or color temperatures of the perceived light that can generated by the at least one lighting unit;

at least one color engine to provide at least one lighting command to the at least one controller, based on a desired color specified in the working color space and the at least one target color management profile, so as to generate a single color of the perceived light, wherein the at least one lighting unit is configured to provide ambient illumination that includes the single color of the perceived light at a given time, the single color of the perceived light corresponding to the desired color specified in the working color space; and at least one color library coupled to the at least one color engine to store the desired color specified in the working color space, wherein the at least one color library is configured to store a plurality of color samples each specified in the working color space, and wherein the system further includes at least one user interface configured to facilitate a selection of the desired color from the plurality of color samples.

2. The color-managed illumination system of claim 1, wherein the working color space includes a CIE color space, and wherein the at least one target color management profile is formatted as an ICC profile.

3. The color-managed illumination system of claim 1, wherein the plurality of color samples includes at least one of an ink color sample, a paint color sample, a fabric color sample, and a colored filter color sample.

4. The color-managed illumination system of claim 1, wherein the plurality of color samples includes a plurality of vendor-specified color samples.

5. The color-managed illumination system of claim 1, wherein the at least one color library is configured to store a plurality of illuminant spectrums specified in the working color space.

6. The color-managed illumination system of claim 5, wherein the desired color is based on a combination of a selected illuminant spectrum of the plurality of illuminant spectrums and a selected color sample of the plurality of color samples.

7. The color-managed illumination system of claim 1, wherein the at least one color engine is configured to provide the at least one lighting command such that the single color of the perceived light approximates the desired color if the desired color is not within the lighting unit color gamut.

8. The color-managed illumination system of claim 1, further comprising a source color management profile representing a second mapping from a device gamut that specifies a second range of colors for a source color device to the working color space, wherein the at least one color engine is configured to receive source color data representing the desired color from the source color device and provide the at least one lighting command to the at least one controller of the at least one lighting unit based on the source color data, the source color management profile, and the target color management profile.

9. A color-managed illumination method for providing ambient illumination that includes a single color of a perceived light at a given time, the method comprising acts of:

A) energizing at least one first LED to generate first light having a first spectrum;

B) energizing at least one second LED to generate second light having a second spectrum different from the first spectrum;

C) controlling the first light and the second light so as to generate a range of colors or color temperatures of perceived light based at least in part on at least one target color management profile associated with at least the first spectrum and the second spectrum, the at least one target color management profile representing a first mapping from a working color space for the color-managed illumination method to a lighting color gamut that specifies the range of colors or color temperatures of the perceived light that can be generated, D) specifying the desired color in the working color space, wherein the single color of the perceived light corresponds to the desired color; and E) providing at least one lighting command to control the first light and the second light, based on the act D) and the at least one target color management profile, so as to generate the single color of the perceived light; and F) storing the desired color in at least one color library, wherein the act F) includes acts of:

F1) storing a plurality of color samples, each specified in the working color space, in the at least one color library; and F2) selecting the desired color from the plurality of color samples.

10. The color-managed illumination method of claim 9 wherein the working color space includes a CIE color space, and wherein the at least one target color management profile is formatted as an ICC profile.

11. The color-managed illumination method of claim 9, wherein the plurality of color samples includes at least one of an ink color sample, a paint color sample, a fabric color sample, and a colored filter color sample.

12. The color-managed illumination method of claim 9, wherein the plurality of color samples includes a plurality of vendor-specified color samples.

13. The color-managed illumination method of claim 9, further comprising an act of storing a plurality of illuminant spectrums, each specified in the working color space, in the at least one color library.

14. The color-managed illumination method of claim 13, further comprising selecting one illuminant spectrum of the plurality of illuminant spectrums and one color sample of the plurality of color samples to specify the desired color.

15. The color-managed illumination method of claim 9 wherein the act E) comprises an act of:

providing the at least one lighting command such that the single color of the perceived light approximates the desired color if the desired color is not within the lighting color gamut.

16. The color-managed illumination method of claim 9, wherein the act E) comprises acts of:

receiving source color data representing the desired color from a source color device; and providing the at least one lighting command based on the source color data, the target color management profile, and a source color management profile representing a second mapping from a device gamut that specifies a second range of colors for the source color device to the working color space.

* * * * *